United States Patent [19]

Resh

[11] 4,135,664

[45] Jan. 23, 1979

[54] LATERAL REGISTER CONTROL SYSTEM AND METHOD

[75] Inventor: Mark S. Resh, Danville, Ill.

[73] Assignee: HurletronAltair, Inc., Danville, Ill.

[21] Appl. No.: 774,664

[22] Filed: Mar. 4, 1977

[51] Int. Cl.[2] ..... B41F 5/16; B65H 23/02

[52] U.S. Cl. ..... 235/475; 226/3; 226/20

[58] Field of Search ..... 226/3, 19, 20; 101/181, 101/183, 228, 219; 235/61.11 R

[56] References Cited

U.S. PATENT DOCUMENTS

| | | | |
|---|---|---|---|
| 3,570,735 | 3/1971 | Kurz | 226/3 |
| 3,683,345 | 8/1972 | Faulkes et al. | 235/92 MP |
| 3,701,464 | 10/1972 | Crum | 226/3 |
| 3,841,216 | 10/1974 | Hoffman | 101/81 |

*Primary Examiner*—Vincent P. Canney

*Attorney, Agent, or Firm*—Hill, Gross, Simpson, Van Santen, Steadman, Chiara & Simpson

[57] ABSTRACT

A lateral register control system utilizing a reference lateral and circumferential mark pair preprinted on the web which is compared with a corresponding mark pair mounted on a drum coupled to the shaft of the print cylinder whose reference is to be controlled. The clock source being an encoder connected to the same print stand as laid down the reference marks on the web. The contents of the cylinder position counters always being slightly greater than the contents of the scanner difference counters and being counted up slightly before the scanner difference counters. Upon sensing a first reference mark on the web, the scanner difference counters are permitted to count. Upon the second reference mark being sensed the fine adjust counters are permitted to start counting. Upon the contents of the fine adjust counters equaling the value of operator setable fine adjust switches, an error pulse train is generated having an associated sign. The error pulse train is accumulated in a repeat counter and is terminated when the contents of the scanner difference counters equal the contents of the cylinder position counters. Said error magnitude may be averaged over several cycles or output directly to a digital analog converter which produces an analog error magnitude. This magnitude serves as the input to the motor control circuitry. Said motor control circuitry being operable to drive the print cylinder lateral position motor at a rate proportional to said analog error signal and in the direction indicated by the sign of said error signal.

10 Claims, 19 Drawing Figures

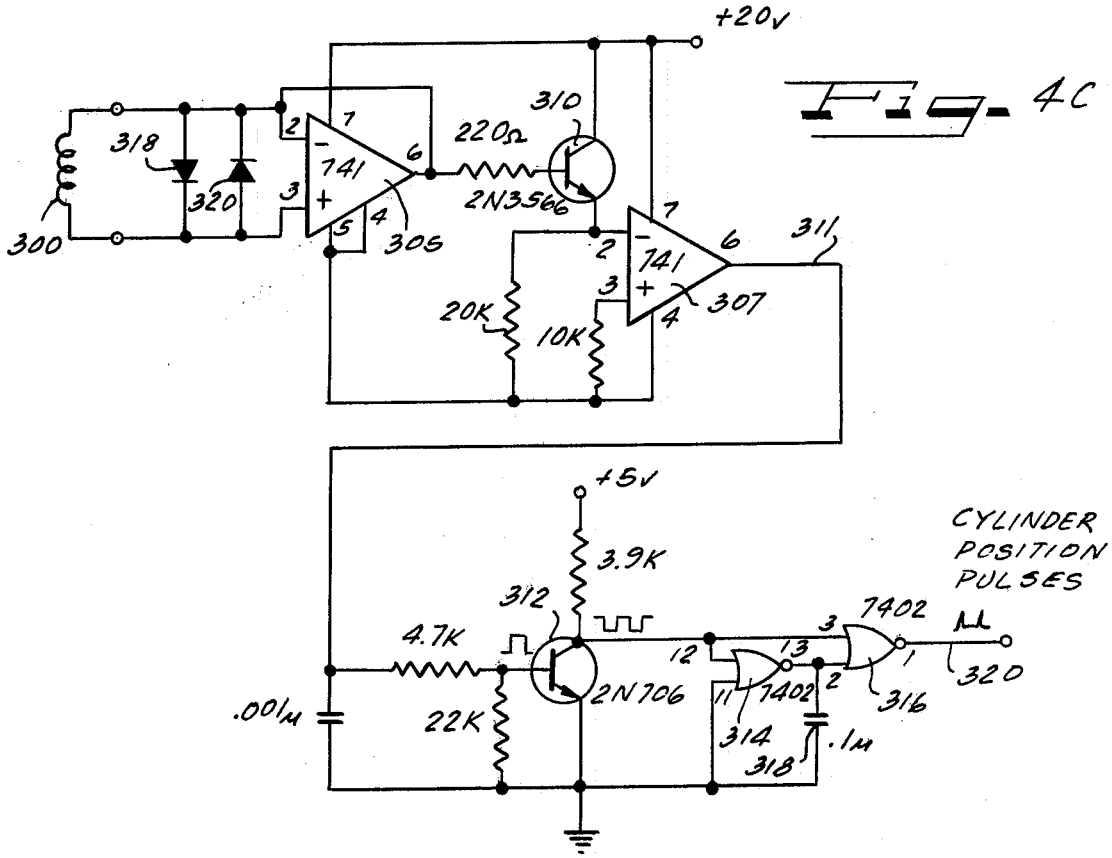
Fig. 4C
Fig. 4D
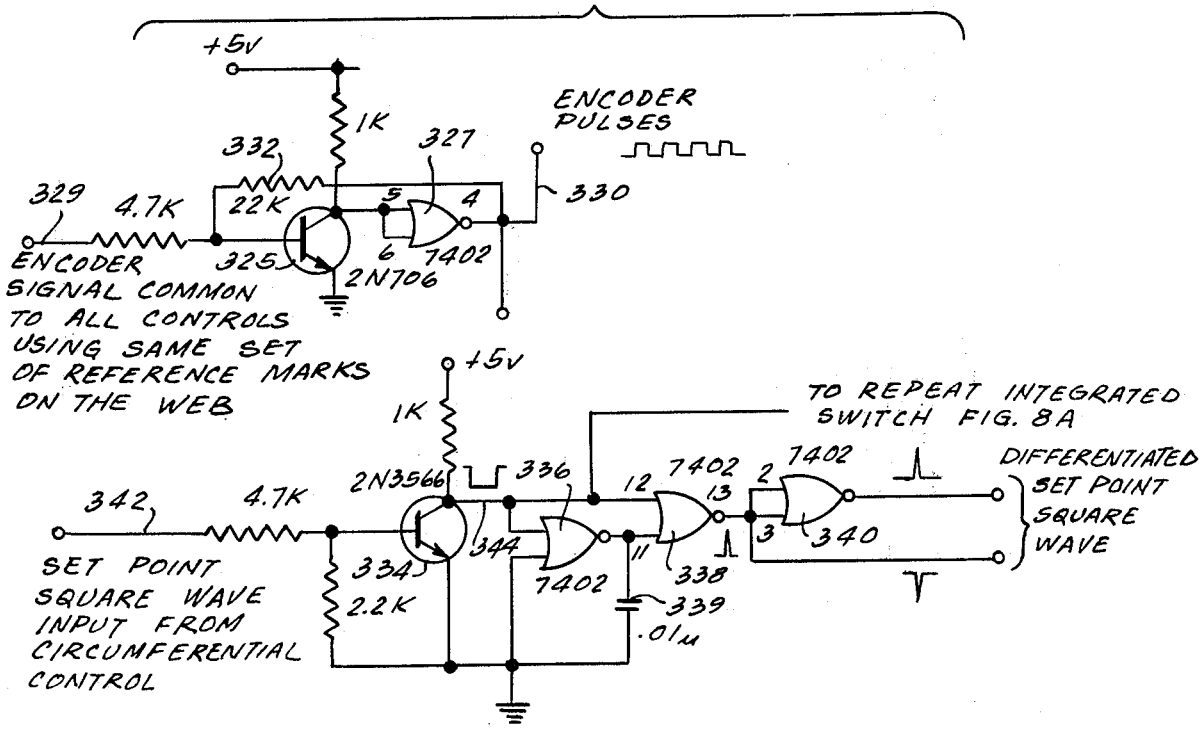

SCANNER DIFFERENCE COUNTERS
FROM FLIP-FLOP 254 FIG. 4B
398
350
352
354
7490A
SN7442
+5V
388
402
EQUALITY TO FIG. 7A
400
ENCODER PULSES FROM FIG. 4D
BUFFER LOAD 394
.01μ
386
SN 74174
SN 74174
384
382
CYLINDER POSITION PULSES FROM FIG. 4C
390
7400
380
364
366
7474
7402
378
368
356
358
360
362
392
CYLINDER POSITION COUNTERS
370
372
374
396

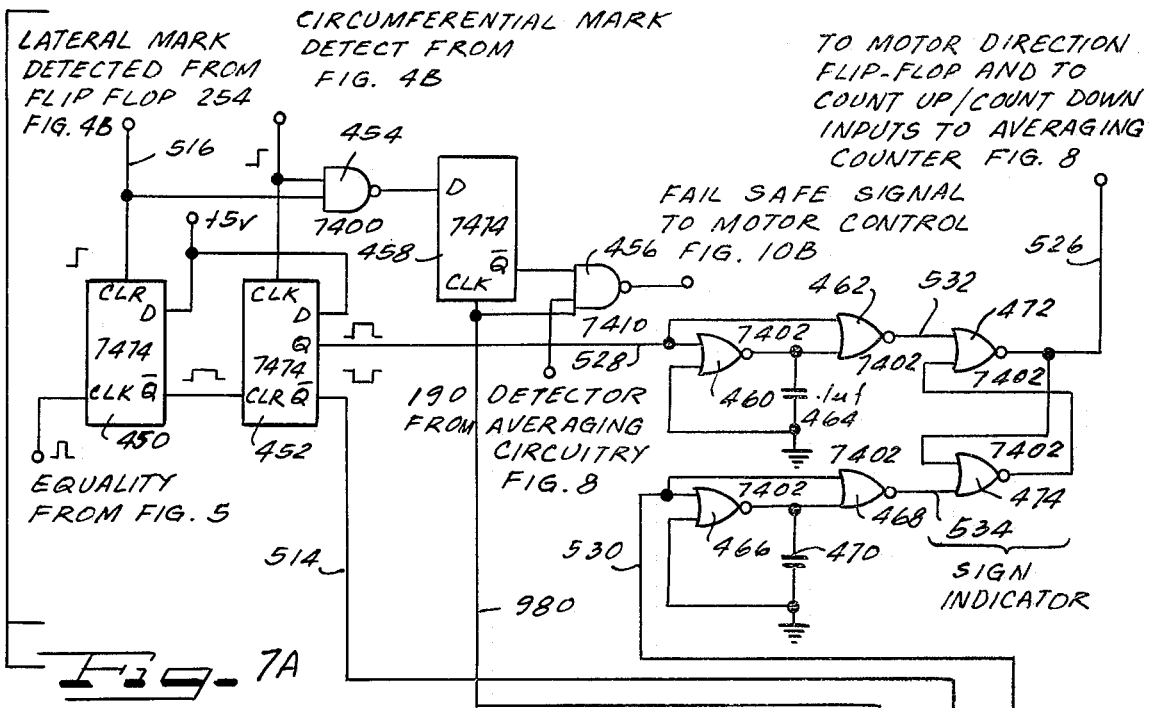
Fig. 7A
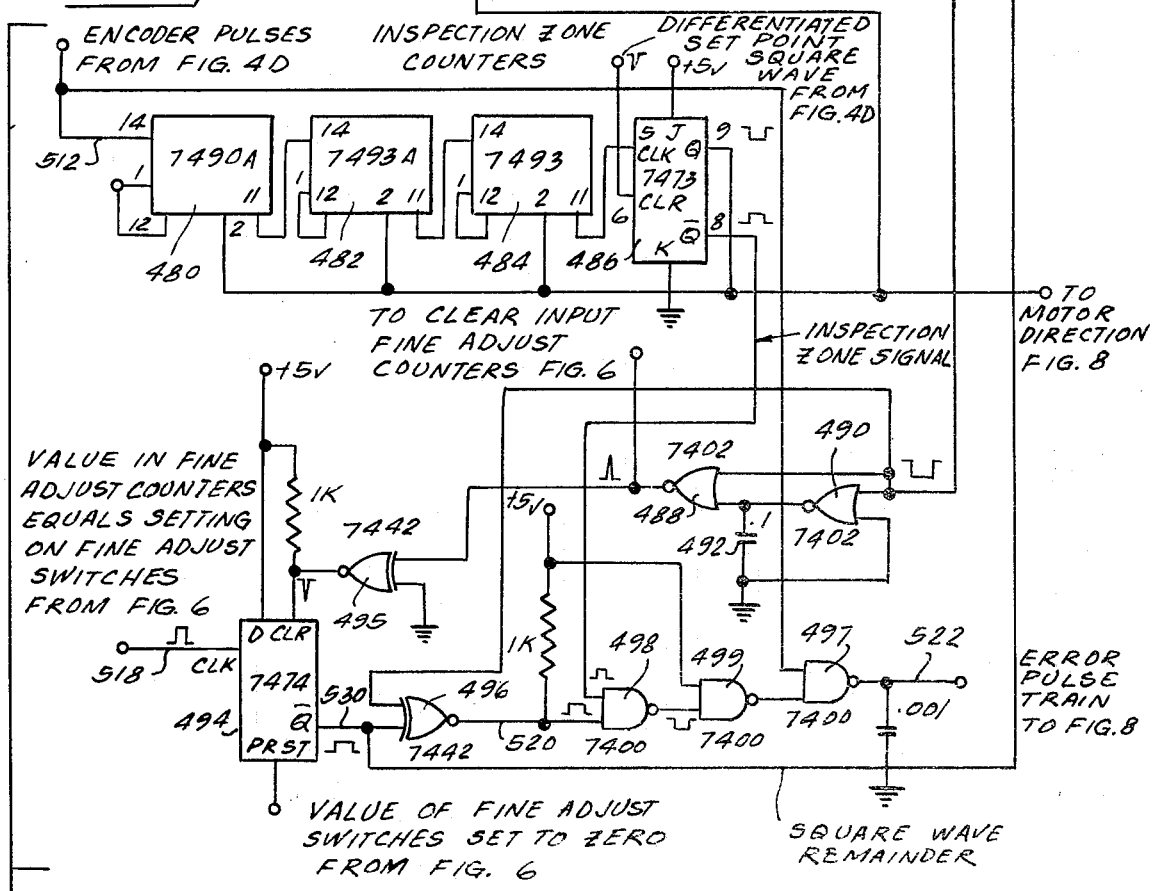
Fig. 7B
Fig. 7

LINE 528
NEGATIVE OF LINE 528
LINE 530
LINE 520
LINE 534
LINE 532
LINE 526
HIGH OR LOW
TIME
HIGH OR LOW
TIME
TA TB TC
SEQUENCE #1
TD TE TF
SEQUENCE #2
SIGN INDICATOR LINE 526 FIG. 7A
SET POINT SQUARE WAVE
LINE 644 FIG. 8A
HIGH OR LOW
LINE 632 FIG. 8A
LINE 628 FIG. 8A
* SAME TIMES AS IN FIG. 7C
TB* TC*
TIME

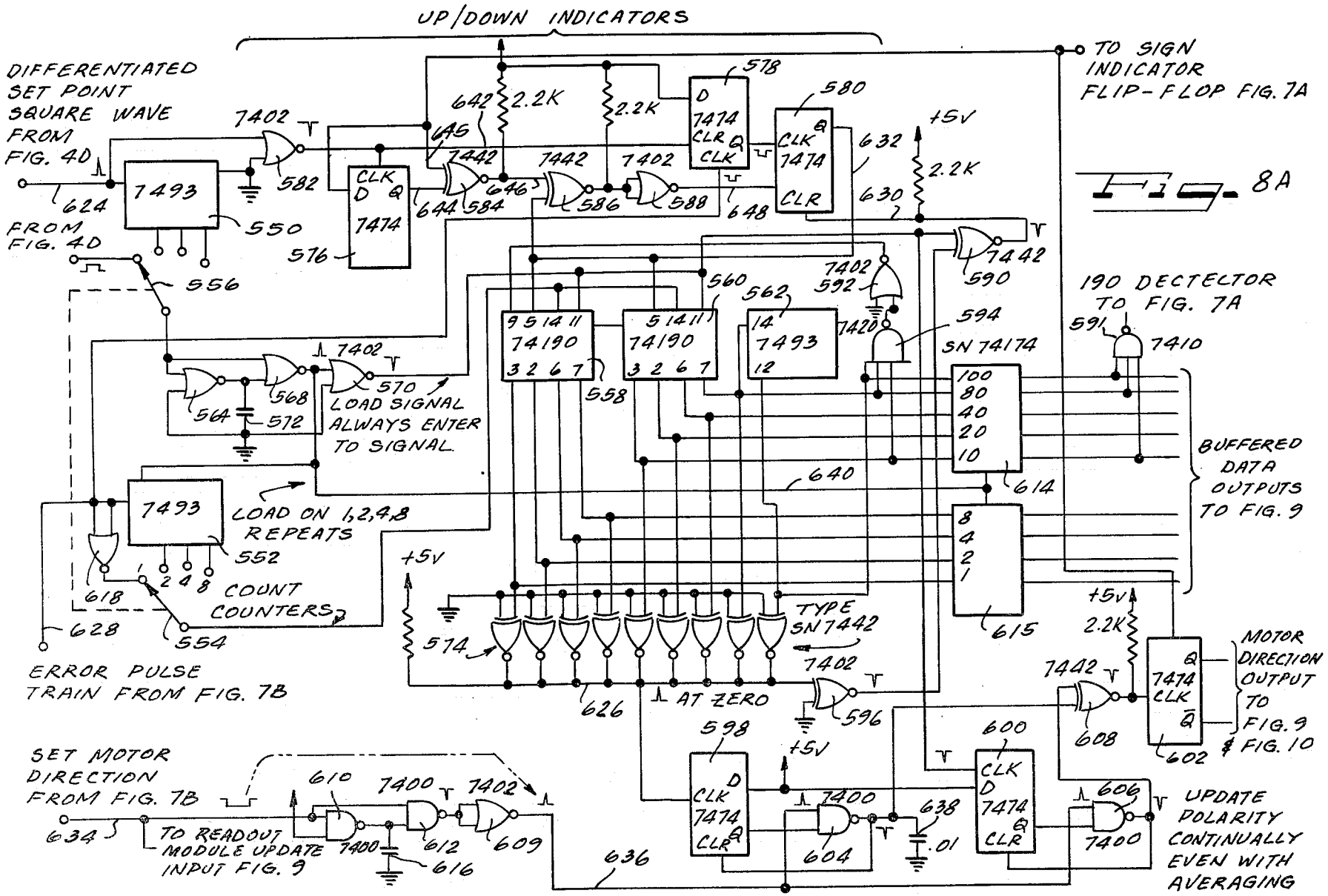
FIG. 8A
TO SIGN INDICATOR FLIP-FLOP FIG. 7A
190 DECTECTOR TO FIG. 7A
BUFFERED DATA OUTPUTS TO FIG. 9
MOTOR DIRECTION OUTPUT TO FIG. 9 & FIG. 10
UPDATE POLARITY CONTINUALLY EVEN WITH AVERAGING
UP/DOWN INDICATORS
SN 74174
TYPE SN7442
AT ZERO
LOAD SIGNAL ALWAYS ENTER TO SIGNAL
LOAD ON 1,2,4,8 REPEATS
COUNT COUNTERS
DIFFERENTIATED SET POINT SQUARE WAVE FROM FIG. 4D
FROM FIG. 4D
ERROR PULSE TRAIN FROM FIG. 7B
SET MOTOR DIRECTION FROM FIG. 7B
TO READOUT MODULE UPDATE INPUT FIG. 9

+5V
700
FROM MOTOR DIRECTION FLIP-FLOP FIG. 8A
706
708
710
712
SN 7447
SN 7447
714
READOUT MODULE UPDATE INPUT FROM FIG. 8A
BUFFERED DATA OUTPUTS FROM FIG. 8A
D/A CONVERTER
716
ANALOG ERROR TO MOTOR CONTROL FIG. 10B
718

SINGLE PHASE AC INPUT 802
806
832
830
804
TO LATERAL POSITION & LINKAGE OF PRINT CYLINDER
828
972
970
974
808
826
(SECONDARY
814
836
TO MOTOR DIRECTION FLIP-FLOP Q OUTPUT FIG. 8A
822
816
810
818
TO MOTOR DIRECTION INPUT FIG. 10B
812
824
834
820
838
TO MOTOR DIRECTION FLIP-FLOP Q̄ OUTPUT FIG. 8A
FAIL-SAFE RELAY INPUT FROM CIRCUMFERENTIAL CONTROL UNIT

SECONDARY TRANSFORMER 808
t
LINE 836 Q INPUT FROM MOTOR DIRECTION FLIP-FLOP FIG. 8A
t
LINE 834
t

LATERAL REGISTER CONTROL SYSTEM AND METHOD

BACKGROUND OF THE INVENTION

Circumferential control of the web has been the subject of extensive past development work. In U.S. Pat. No. 3,870,936, assigned to the assignee of the present invention, some of the past work is set forth. Related to the circumferential control is the problem of lateral control of the web, the subject of the present disclosure. In U.S. Pat. No. 3,949,282, also assigned to the assignee of the present invention, a system for circumferential or longitudinal control was disclosed. That system required a set of marks to be printed on the web by print-stand A while a downstream print-stand, call it B, printed a second set of marks on the web. Two scanners sensed the two sets of marks and the control system compared them in time. The difference in position detected in the two sets of marks was an error signal providing inputs to an error correcting device of some type. The adjustment was made on print-stand B. Thus, it can be seen that the position of print roller B was indirectly compared to the reference marks printed by print-stand A and an adjustment then made at print-stand B. The indirect measurement of the position of print-stand B off of a printed mark resulted in less accuracy than was desirable. Furthermore, the method of measurement inherently resulted in some misregistration since before an error signal could be generated, the web had been processed by print-stand B.

SUMMARY OF THE INVENTION

The present invention relates to a lateral register control system which alleviates the complexities and inaccuracies of previous attempts to control lateral register. Control is achieved in the present case by taking a measure of the spatial distance between a pair of print cylinder position signals obtained directly off of the print cylinder of which the lateral register is to be controlled comparing that difference to the space between a pair of marks previously laid down on the web. If yellow is the first color laid down, for example, then all succeeding print-stands could compare their lateral position to that pair of yellow marks laid down by the first stand. Error signals are time averaged to smooth servo system response.

It is an objective of this invention to improve lateral register control by being able to directly sense the position of the print cylinder in question. It is a further objective of this invention to develop a less complex and more reliable implementation of a lateral register control than had previously been available. It is a further objective to develop a lateral register control wherein the reference marks may be scanned before or after the print-stand to be controlled. It is a further objective to use any available signals from a circumferential register control system of the type disclosed in U.S. Pat. No. 3,601,587 in order to minimize the cost of the present invention.

BRIEF DESCRIPTION OF THE DRAWINGS

FIG. 4C illustrates the print cylinder position processing circuitry;

FIG. 4D illustrates the encoder processing circuitry and the set point square wave processing circuitry;

FIG. 7 consists of 7A through 7C;

FIG. 7A discloses the control circuitry part A;

FIG. 7B discloses the control circuitry part B;

FIG. 8A discloses the repeat circuitry;

DETAILED DESCRIPTION OF THE PREFERRED EMBODIMENT

Figure 1:
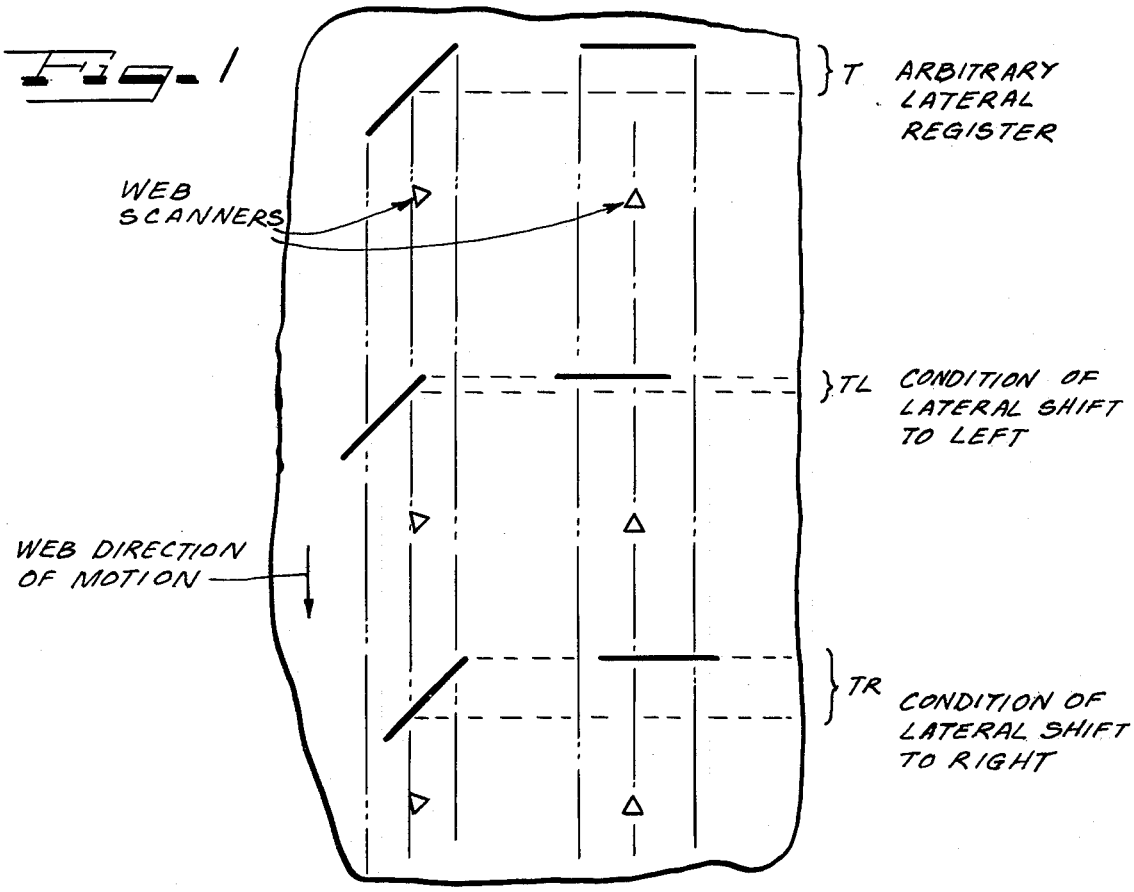
FIG. 1 is a representation of a web showing the basic concept of detection of lateral register.

The basic principle involved here is illustrated by FIG. 1. Two marks, one horizontal and one at an angle, have been previously printed on the web. Three conditions are shown. The top condition, or reference, indicates a situation of arbitrary lateral register of the web. Sensors are associated with each mark. The middle condition illustrates a left shift with respect to the reference marks. Note that the time interval T, the period of time necessary for both sensors in the reference case to detect their respective marks, is less than the time interval TL. Similarly, a right shift results in the bottom condition of FIG. 1 with TR being a smaller time interval than T. As can be seen, both marks are needed to detect a lateral shift.

Figure 2:
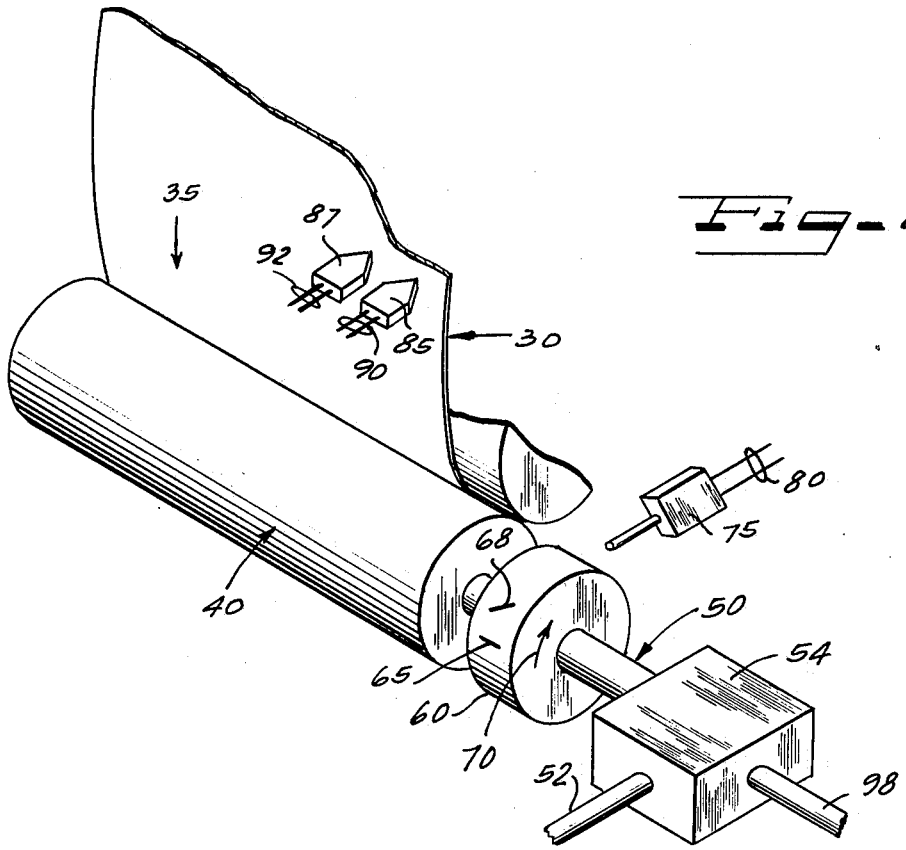
FIG. 2 illustrates the print cylinder, drum position indicator and web physical arrangement.

In the present invention, a pair of reference marks are laid down by the first print-stand usually in yellow ink. All subsequent print-stands can then use said yellow marks as a reference. It should be noted that the practice of this invention is *not* limited to cases where the marks are printed on the web at an upstream print station. The invention would work in the same fashion if the reference marks had been preprinted before the web was mounted on the present printing press. In the present invention, the actual lateral register of the web is detected by means of a drum coupled to the print cylinder. FIG. 2 discloses conceptually how the reference mark would be detected off of the web and how the actual print cylinder position would be detected using the drum. FIG. 2 discloses a web 30, direction of web travel 35, print cylinder 40, supporting shaft 50, print roller rotary drive 52, gear box 54, position cylinder 60, ferrous markers 65, 68, magnetic pick-up unit 75, optical sensors to read the reference marks off of the web 85, 87, and an input shaft 98 to effectuate lateral shifting of the print cylinder 40. With respect to FIG. 2, a web 30 approaches a print cylinder 40 which rotates on a shaft 50. The shaft 50 would be supported in a known fashion and driven through a standard drive train 52 and gear box 54. Mechanically attached to the shaft 50 is a drum 60 made of a non-magnetic material such as aluminum. Attached to the drum 60 are two ferrous wires 65, 68 of a material such that as the drum 60 turns as indicated by the arrow 70, the magnetic pick-up unit 75 detects the presence of said two wires and puts out a pulse for each on the wire 80. One of the two wires is attached parallel to the axis of rotation of the cylinder. The other at a predetermined angle to it of 63.4°. This pair of pulses indicates the actual lateral position of print cylinder 40. The reference pulses are detected off of the web 30 by a pair of optical scanners 85 and 87 which respectively scan for a yellow horizontal and angled mark as indicated in FIG. 1. The pulse outputs of scanners 85 and 87 appear respectively on the wires 90 and 92. Two scanners are used if the reference marks are laid down next to one another on the web. If the marks are printed serially on the web only one scanner would be needed. This is analogous to the single detector 75 which senses the presence of the two marks 65 and 68 sequentially on the drum 60. It should be noted that the placement on the drum 60 of the two marks is quite arbitrary but the preferred placement is with the two marks 65 and 68 slightly further apart at their midpoints than the distance between the two marks on the web 30 when there is zero registration error. Hence, when in register, as disclosed subsequently, an offset is manually entered into the control system. Once the two sets of signals on the lines 80 indicating actual print cylinder position and the lines 90, 92 indicating the reference position, have been acquired, they are compared electronically. Depending on the difference of time intervals between first the two marks 65, 68 indicating actual position of print cylinder 40 and secondly the time interval between the set of marks on the web 30 as sensed by the sensors 85, 87 the print cylinder 90 is shifted laterally via an input shaft 98 to the gear box 54 to reduce the difference between the two measured time intervals.

Figure 3A:
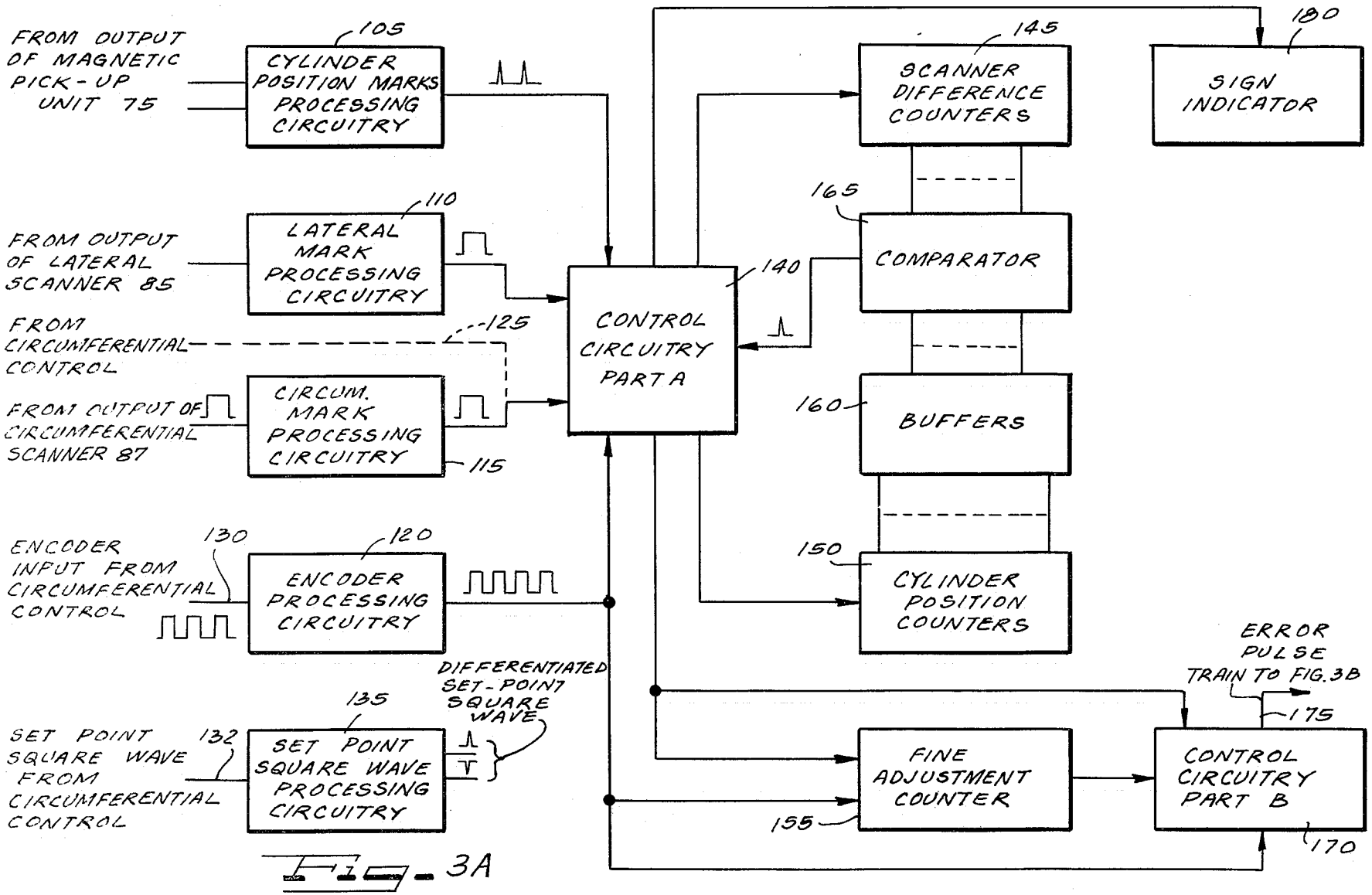
FIG. 3A discloses a block diagram of the present invention up to the point of producing an error pulse train.

FIG. 3A illustrates the block diagram of the invention. As can be seen, the cylinder position mark circuitry 105, the lateral mark processing circuitry 110, the circumferential mark processing circuitry 115 and the encoder processing circuitry 120 all carry out pre-processing of the four inputs. The magnetic pickup signals are generated by the pickup element 75 as the cylinder 60 rotates. The lateral scanner marks are detected by scanner 85. Note that the dashed line 125 bypasses the circumferential mark processing circuitry 115. The preferred embodiment is used with a circumferential control such as that disclosed by U.S. Pat. No. 3,601,587 wherein the circumferential marks are detected and already pre-processed. The encoder input on the line 130 comes from a digital incremental encoder which outputs 20,000 pulses/revolution. This encoder, in the preferred embodiment, is connected to the print cylinder which lays down the reference marks on the web. In the preferred mode of operation, on one side of the web, the yellow color is laid down at the first print-stand. This is the same stand to which said encoder is connected. The output from said encoder is supplied to all downstream lateral and circumferential control systems. The set point square wave signal on the line 132, FIG. 3A, is produced by the circumferential control of U.S. Pat. No. 3,601,587 by reference generator 23 of that patent.

With reference again to FIG. 3A, outputs from the previously mentioned pre-processing elements 105, 110, 115 and 120 provide inputs to the control circuitry part A, 140. Said control circuitry determines when the scanner difference counters, 145, the cylinder position counters, 150, and the fine adjustment counters 155 are permitted to count. The buffers 160 contain the previously acquired contents of the cylinder position counters 150. This value is compared to the difference presently being acquired between the two web marks which is being summed into the scanner difference counters 145. These two values are compared for equality by the comparator 165. Binary coded numbers are used throughout this system. As a result, all counters are decade counters. The digital to analogue converter discussed later is a BCD to analogue voltage conversion device.

Figure 3B:
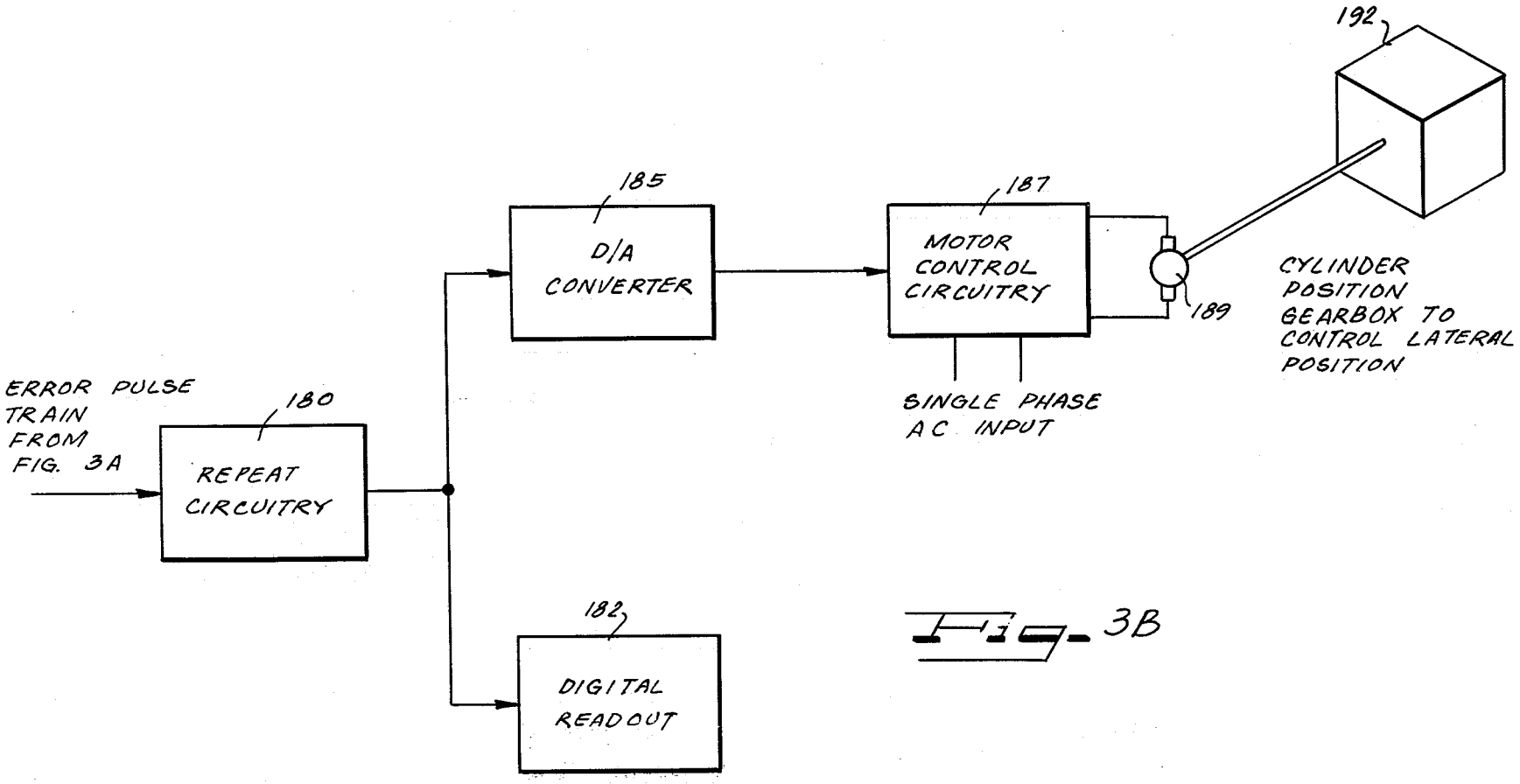
FIG. 3B discloses a block diagram of the present invention with the error pulse train of FIG. 3A as an input through the lateral position motor.

The difference between the value in the cylinder position counters 150 and the value in the scanner difference counters 145 is reduced by the value in the fine adjust counter 155 and then is converted into a string of error pulses by the control circuitry part B, 170, and appears at the line 175. This string of error pulses with associated sign from the sign indicator 180 forms the input to the repeat circuitry 180 of FIG. 3B. The output of the repeat circuitry 180 is read out at the digital readout 182, converted to an analogue voltage by the D/A converter 185 and used to drive the motor control circuitry 187.

It should be noted that the value in the cylinder position counters, 150, is always greater than the value found in the scanner difference counter 45. When the web is running in register, the remaining error is subtracted out by means of the operator preset value to which the fine adjust counter, 155, is set. In the preferred embodiment, the smallest interval between the wires on the cylinder 60 corresponds to 512 encoder pulses. With respect to the web marks, the preferred size is ¼" long by 1/16" wide with one mark (the circumferential) being perpendicular to the direction of web movement and the second (the lateral mark) at a 45° angle to the first.

Figures 4A, 4B:
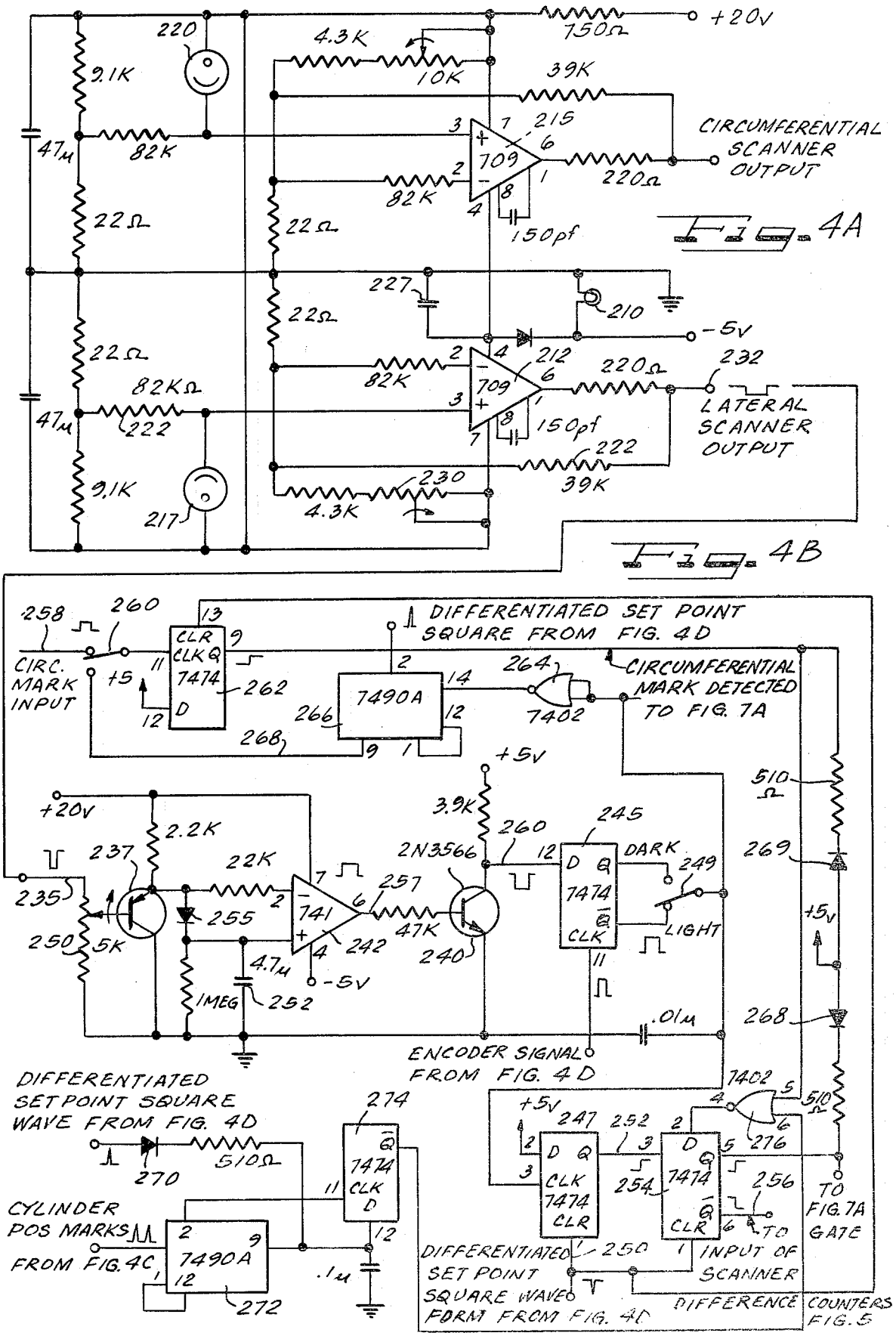
FIG. 4A illustrates the scanner processing circuitry.
FIG. 4B illustrates the circumferential and lateral mark detection logic.

FIG. 4A illustrates the electronics associated with the lateral scanner 85 and the circumferential scanner 87. When the present invention is used with a circumferential registry control system, such as disclosed in U.S. Pat. No. 3,601,587 then the circumferential scanner output signal is input to the circumferential register control of Appendix A as well as to the present invention. The two units consist of a source of illumination 210, operational amplifiers 212 and 215, phototubes 217 and 220 and assorted resistors, diodes and capacitors, the use of which would be known to one ordinarily skilled in the art. With respect to FIG. 4A, lamp 210 emits light into two fiber-optic bundles (not shown). The light is projected on the web in the shape of rectangle and is reflected back to the scanner heads. One fiber-optic head containing operational amplifier 215 and phototube 220 is used to detect the circumferential mark. This scanner head is utilized by both circumferential and lateral control systems. The other scanning head, monitors the web looking for an angled mark (45° to a line parallel to web movement) to compare with the circumferential mark. This angle may be altered to increase or decrease system sensitivity.

The reflected light passes through the fiber-optic bundle to a phototube 217 or 220. Half of the fibers transmit light from the lamp and the other half of the fibers transmit the reflected light back to the scanner onto a phototube.

The signal from phototubes 217 or 220 are fed to operational amplifiers 212 or 215 which have a gain of 1000 to amplify the phototube signals.

Since there are two identical circuits, the following explanation holds for both.

The signal from phototube 217 enters the operational amplifier 212 on the non-inverting port, pin 3. The output of the amplifier 212 is at pin 6. The resistor 222 provides negative feedback to pin 2, the inverting input. The signal at the output of the operational amplifier 212 will have a 12v dc level for a normal white background. A yellow mark on the white background should produce a 3 to 5 volt negative going pulse from this 12v dc level.

The diode 225 and the capacitor 227 are used to filter the −5 volt power supply.

The dc level output by the operational amplifier 212 can be changed by adjusting the potentiometer 230. The dc level should be adjusted so that it is approximately 1 volt less than the saturation level of the operational amplifier when the scanner is ⅛" away from the web and when the scanner lamp 210 has −5.0 volts for a supply voltage.

The output from the lateral scanner on the line 232 is input to the lateral mark processing circuitry of FIG. 4B at the line 235. Said circuitry consists of transistors 237 and 240, the operational amplifier 242, the D flip-flops 245 and 247, as well as resistors, diodes and capacitors such as would be known to one skilled in the art. With respect to FIG. 4B, the potentiometer 250 is used to adjust the sensitivity of the scanner of FIG. 4A. Adjusting the potentiometer 250 determines how much of the negative going signal on the line 235 is used to bias the base of emitter follower 237. Capacitor 252 will change up to a dc level corresponding to a white web passing under the lateral scanner.

When a yellow mark passes under the lateral scanner, the voltage at the emitter of the transistor 237 follows the drop in voltage on the line 235. This drop revise biases the diode 255 reversing the polarity at the input of the operational amplifier 242 which puts out a positive going pulse on the line 257. This positive going pulse turns on the transistor 240 which acts as an inverter. An inverted pulse appears on the line 260 which is the D input to flip-flop 245. Note that the clock input to the flip-flop 245 is the processed encoder signal from the element 120, FIG. 1. This use of the encoder signal is for synchronization purposes so that there will be no possibility of pulses splitting. Note that when the flip-flop 245 receives a low signal at the D input, on the line 260, and the next encoder signal arrives, the flip-flop 245 will change state causing the negated output of the flip-flop 245 to go high until the D input goes high again. The pulse out of the flip-flop 245 passes through the switch 249 and into the clock input of the flip-flop 247. The position of switch 249, as shown, is for the case of a light web (white, for example) with a dark mark (yellow, red or blue, for example). Flip-flop 247 is always cleared via the line 250 by the differentiated, negative going set point square wave generated by the element 135 of FIG. 1. Thus, the positive going signal on the line 252 sets the reset flip-flop 254, whose D input is normally high, on the first encoder pulse *after* the lateral mark is detected by the lateral scanner. The negative going output of the flip-flop 254 on the line 256 drives the gate input to the scanner difference counters, element 145 of FIG. 1. When the signal on the line 256 goes low, the scanner difference counters are cleared and on the same encoder pulse as set the flip-flop 245, the scanner difference counters start counting. Shortly after the lateral signal, the circumferential mark is detected in the circumferential control and input on the line 258. If the switch 260 is in the position indicated, the flip-flop 262 which is reset by the set point square-wave at the start of every error cycle is set. If only a lateral scanner is to be used, switch 260 is set to the other possible state. In this condition, every pulse detected by this flip-flop 245 is fed via the gate 264 to the divide by two counter 266. On the line 268, every second web mark would be fed to the flip-flop 262.

The three diodes 268, 269 and 270 are light emitting diodes indicating that the associated flip-flops have changed state. The elements 272, 274, 276 serve merely as interlocks to insure that the lateral mark is detected before the circumferential or cylinder position marks.

FIG. 4C illustrates the cylinder positioning marks processing circuitry, element 105, of FIG. 1. The magnetic position pick-up amplifier of FIG. 4C is composed of coil 300, operational amplifiers 305 and 307, transistor 310, as well as resistors and diodes as would be known to one ordinarily skilled in the art. The output of the magnetic pick-up amplifier on the line 311 supplies input to the low level shaping circuitry composed of the transistor 312, the NOR gates 314 and 316 as well as resistors and diodes and would be known to one ordinarily skilled in the art. With respect to FIG. 4C, the voltage induced in the coil 300 due to the rotating wires 65 and 68 of FIG. 1 is limited by diodes 318 and 320 and is input to the operational amplifier 305. The output of the element 305 provides input to the transistor 310 operated as an emitter follower. The operational amplifier 307 amplifies and shapes the output of emitter follower 310. The previous amplifier components are housed in the element 75, FIG. 1. The output of said amplifier is dispatched via the line 311 to the low level shaping circuitry and is amplified and inverted at the transistor 312. The two NOR gates 314 and 316 along with capacitor 318 convert the negative going signal from the transistor 312 and convert it to a positive going pulse as follows.

A negative going square-wave enters the NOR gates 314, 316 on pins 12 and 3. Since pin 11 is tied to ground, pin 13, the output of NOR gate 314 will start to go positive when pin 12 goes low. The time it takes pin 13 to go high, however, will be delayed by the capacitor 318 to ground. At the NOR gate 316, a high to low going wave is present at pin 3 and a low to high going wave is present on pin 2. The delay of the transition going high at pin 2 will result in a positive going pulse of length at pin 1 equal to the delay of the wave on pin 2. The output on the line 320 labeled Cylinder Position Pulses is a pair of pulses for each revolution of the print cylinder and corresponding in time to when the wires 65 and 68 pass under the sensor 75 of FIG. 1. The time duration between these marks is used to permit encoder pulses to count up the cylinder position counters, 150 of FIG. 1.

FIG. 4D illustrates the encoder processing circuitry, element 120 of FIG. 1. The encoder processing circuitry consists of the transistor 325, NOR gate 327 and several bias resistors. The encoder signal common to a group of print stands is brought in on the line 329. It is inverted and amplified by the transistor 325. The signal is amplified and inverted again by NOR gate 327 and the output on the line 330 is also fed back to the base of 325 via resistor 332 to improve the waveshape's rise and fall times.

FIG. 4D also illustrates the set point square-wave processing circuitry element 125 of FIG. 1. This circuitry consists of the transistor 334, a pulse generator consisting of NOR gates 336, 338 and capacitor 339, inverting NOR gate 340 and bias and load resistors.

The set point square-wave is generated in the circumferential control, and is true for the first half of the total inspection zone. Only the leading edge of it is used in the present invention. The start of the set point square-wave generates two simultaneous pulses — the differentiated positive going pulse and an inverted differentiated pulse. Both of these pulses are used to reset assorted flip-flops or zero counters throughout the rest of the invention. With respect to FIG. 4D, the set point square-wave wave generated by the related circumferential control is brought in on the line 342, inverted by the transistor 334 and converted to a pulse by the pulse generator consisting of NOR gates 336, 338 and timing capacitor 339. The output of said pulse generator, as discussed previously, is a positive going pulse coincident with the negative going transistors on the line 344. NOR gate 340 provides the inverted output.

Figure 5:
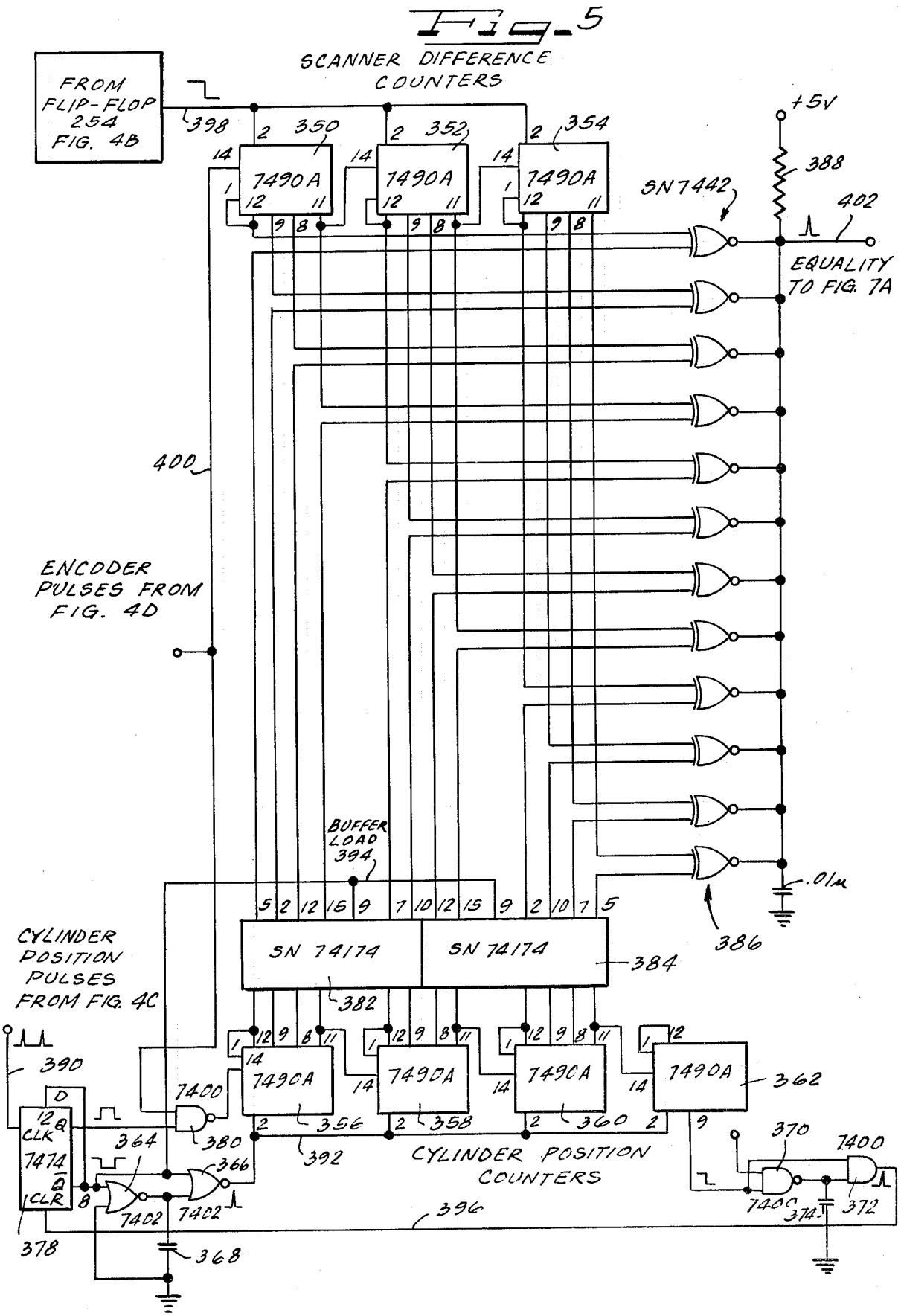
FIG. 5 illustrates the scanner difference counters, cylinder position counters and comparator circuitry.

FIG. 5 discloses the details of the scanner difference counters 145, the cylinder position counters 150, buffer flip-flops 160 into which the contents of the cylinder position-counters are loaded for later comparison to the contents of the scanner difference counters, and the comparator 165, all originally illustrated in block diagram form in FIG. 3A. Three SN 7490A BCD counters 350, 352 and 354 make up the scanner difference counters. Four BCD counters 356, 358, 360 and 362, along with two pulse generators, a first composed of gates 364, 366 and capacitor 368 and a second composed of gates 370, 372 and capacitor 374 as well as flip-flop 378 and gate 380, comprise the cylinder position counters. Two six-bit buffers 382, 384 comprise the buffer storage elements. Twelve exclusive NOR gates, represented by collective element 386 with a common load resistor 388 comprise the comparator.

To recapitulate before considering the details of operation of FIG. 5, the invention works basically as follows:

(1) A first cylinder position-pulse appears clearing the cylinder position counters and permitting them to receive encoder pulses which count them up.

(2) The cylinder position counters are counted up until the second cylinder position pulse arrives, at which time the contents of three of the cylinder position counters are loaded into the buffer registers 382, 384.

(3) When a lateral mark is detected, the scanner difference counters start counting.

(4) The circumferential mark which comes subsequent to the lateral mark is used by control circuitry A, 140 of FIG. 3A, to start counting the fine adjustment counter 155 of FIG. 3A.

(5) The number of encoder pulses which appear between when the circumferential mark appears and when the comparator 386 of FIG. 5 gives out an equal signal, less the value preset for the fine adjust counter 155 of FIG. 3A is the error signal which appears on the line 175 of FIG. 3A.

With respect to FIG. 5, a first cylinder position pulse arrives on the line 390 and causes flip-flop 378 to become set. At the end of every cycle, said flip-flop is reset by the second cylinder position pulse. When pin 8 of the flip-flop 378 goes down, the pulse generator composed of elements 364, 366 and 368 generates a pulse on the line 392 which zeros counters 356, 358, 360 and 362. Encoder pulses gated by gate 380 count up the four cylinder position counters. Upon arrival of the second cylinder position pulse, the flip-flop 378 is reset disabling the gate 380 and on the line 394 the positive going signal loads the buffers 382, 384 with the present contents of the cylinder position counters 356, 358, 360.

It should be noted that the cylinder position counters cannot detect the correct first cylinder position pulse when the control is being initially turned on. To insure that the small time interval between the wires 65 and 68 of FIG. 1 is being counted, as opposed to the much longer time interval between the wires 68 and 65, the counter 362 and pulse generator composed of the elements 370, 372 and 374 are used. Note that if the long time interval is being counted, then the decade counter 362 will output a down going signal from the "two" bit at pin 9 of the counter which will cause the associated pulse generator to produce a clear signal on the line 396 which resets the flip-flop 378 and stops the sequence until the next and hence correct cylinder position pulse arrives on the line 390.

Shortly after the contents of the cylinder position-counters are loaded into the buffers 382 and 384, the lateral mark is detected and the scanner difference counters 350, 352, 354 are reset when the flip-flop 254 of FIG. 4B sets and a down going level appears on the line 398. Since the encoder input to these counters on the line 400 is always enabled, the scanner difference counters are always counting. The BCD output of the scanner difference counters 350, 352, 354 is compared to the contents of the buffers 382, 384 in the comparator 386. Said comparator consists of exclusive NOR gates and makes bit by bit comparisons in a known fashion with the outputs of all twelve exclusive NOR gates forming a wired AND gate in conjunction with the load resistor 388. It should be noted that the equality signal produced on the line 402 always occurs after the second mark off the web, the circumferential mark has occurred.

Figure 6:
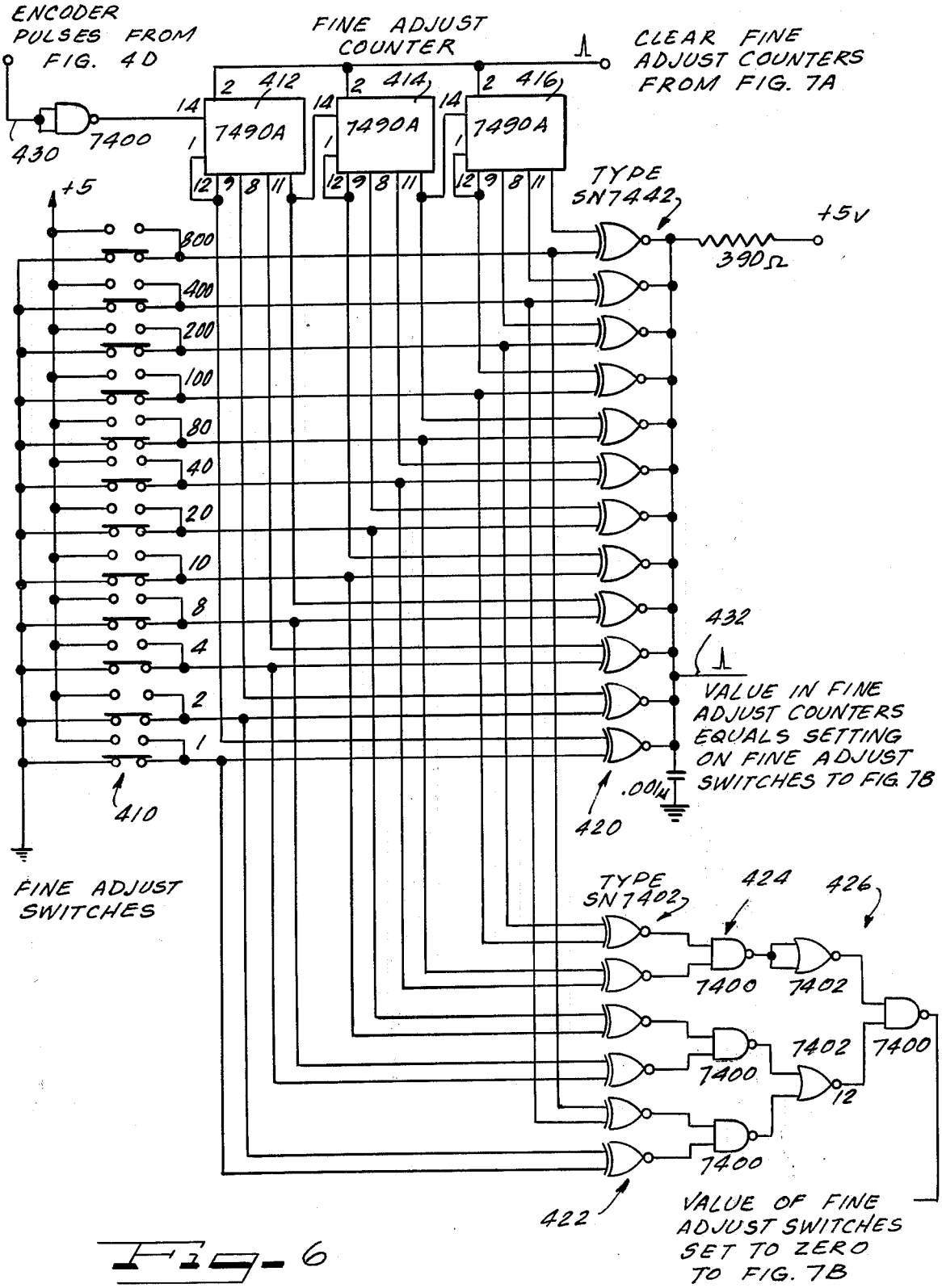
FIG. 6 discloses the fine adjust counter circuitry.

FIG. 6 discloses a circuitry associated with the fine adjust counter element 155, FIG. 3A. A set of manually adjustable switches, collective element 410, specifies a value to which the three BCD fine adjust counters 412, 414, 416 count to before an equality signal is generated by the comparator, collective element 420, composed of exclusive NOR gates. A second comparator composed of collective elements 422, 424 and 426 detects a setting of all zeros on the manual switches 410. With respect to FIG. 6, when the circumferential scanner is detected a pulse generator in the control circuitry part A, 140 of FIG. 3A, which is disclosed in detail in FIG. 7A, emits a pulse on the line 428 which causes the fine adjust counters 412, 414, 416 to reset. Subsequent encoder pulses on the line 430 cause the fine adjust counters to count. When the contents of the fine adjust counters equals the value previously set on the fine adjust switches, element 410, the comparator element 420 operating in a known fashion emits a pulse on the line 432. Said pulse is then an input to the control circuitry part B of FIG. 7B. If the fine adjust switches 410 are set to zero, the second comparator composed of collective elements 422, 424 and 426 is used to insure that the total error signal is correctly generated by the control circuitry part B as disclosed in FIG. 7B.

FIG. 7A discloses the control circuitry part A, 140 of FIG. 3A, and the sign indicator 180 of FIG. 3A. FIG.

7B discloses the control circuitry part B, 170 of FIG. 3A. The control circuitry part A comprises two timing flip-flops 450, 452 and fail-safe circuitry composed of gates 454, 456 and flip-flop 458. The sign indicator is composed of two pulse generators, a first consisting of gates 460, 462 and a capacitor 464 and a second consisting of gates 466, 468 and a capacitor 470 as well as an R-S flip-flop consisting of gates 472 and 474. The control circuitry part B is composed of the inspection zone counters with the elements 480, 482, 484 and 486, a pulse generator comprising gates 488, 490 and capacitor 492, a gate flip-flop 494 and gates 495, 496, 497, 498 and 499.

With respect to FIG. 7B, initially the differentiated set point square-wave on the line 510 clears the flip-flop 486. The negated side of 486, pin 8, stays true during the entire possible inspection zone, the inspection zone being that portion of time during which the lateral and circumferential marks are to be expected on the web. When the element 486 is cleared, the counters 480, 482 and 484 are reset and count based on encoder pulses arriving on the line 512. The preferred mode of operation is with an encoder which outputs 20,000 counts/-revolution. At the end of the inspection zone, the counter 484 sets flip-flop 486 terminating said inspection zone.

Figures 7C, 8B:
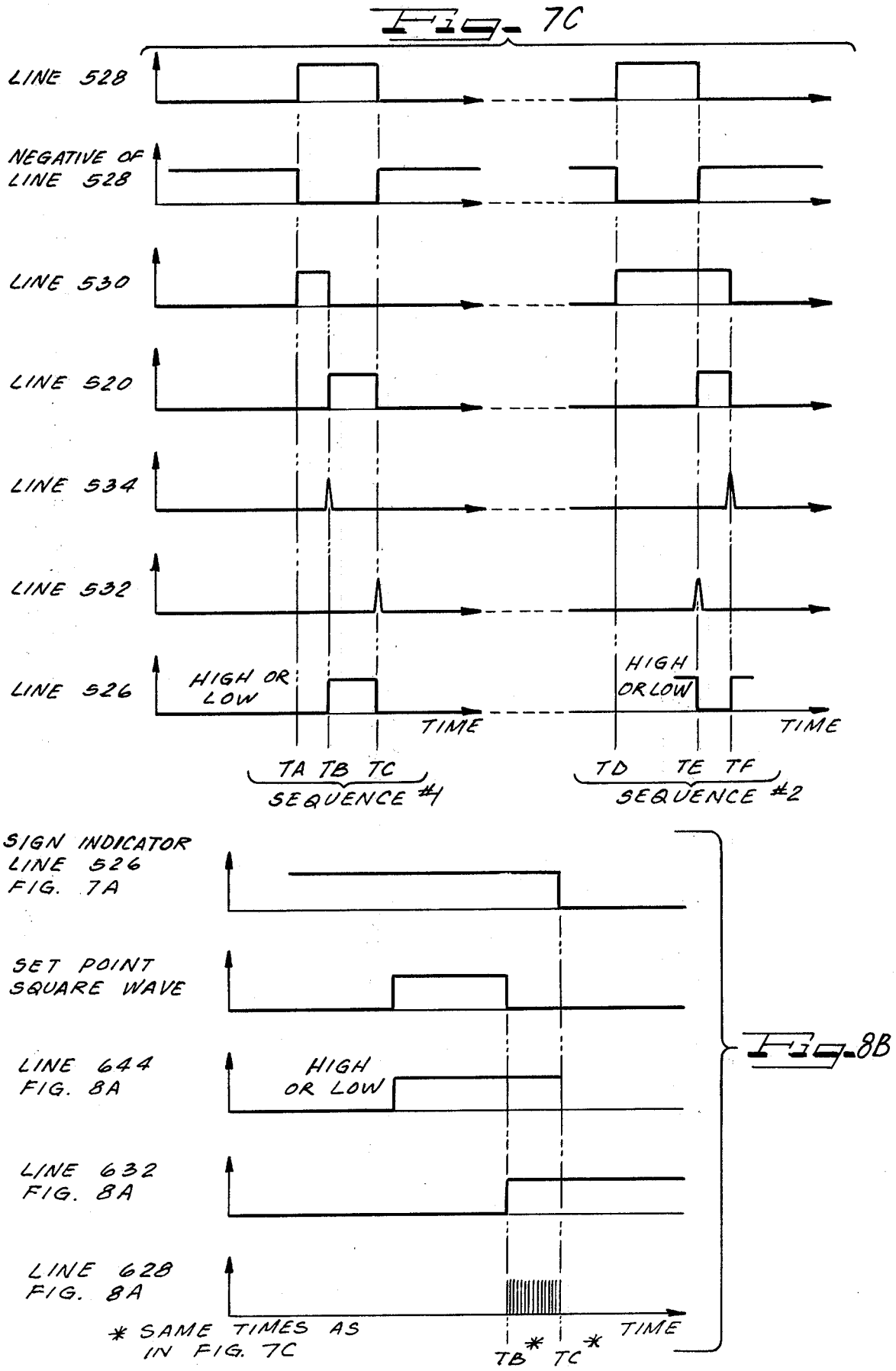
FIG. 8B discloses repeat circuitry timing.

With reference now to FIG. 7A, the two flip-flops 450, 452 output a negative going signal on the line 514 whose width is proportional to the difference of the distance between two web reference pulses and the cylinder position pulses. Before the appearance of the web marks, the flip-flop 450 is set. The flip-flop 452 is reset. The lateral mark arrives first on the line 516 clearing the flip-flop 450. Shortly thereafter, the circumferential mark arrives setting the flip-flop 452. Upon the equal signal being generated on the line 402 of FIG. 5, the flip-flop 450 is set which in turn resets the flip-flop 452. The output of the flip-flop 452 provides input to the pulse generator composed of gates 488, 490 and capacitor 492. FIG. 7B. Said pulse generator via the gate 495 clears the flip-flop 494 which stays cleared until a signal appears on the line 518 indicating that the fine adjust counters 412, 414, 416 have counted up to the values in the collective element 410, FIG. 6. Said pulse on the line 518 sets the flip-flop 494 enabling the gate 496. The output pulse of the gate 496 on the line 520 is proportional to the true system error. Said pulse is ANDED with the inspection zone pulse in the gate 497, inverted in the gate 498 and ANDED with encoder pulses in the gate 499. The output of the gate 499, the error pulse train on the line 522 is then used as the error input to the averaging circuitry of FIG. 8. Said pulse train represents the true error for this cycle. Note must now be made concerning the generation of the polarity of the error signal which is produced on the line 522 of FIG. 7B. The sign indicator, FIG. 7A, is composed of the two NOR gates 472 and 474 wired together as an R-S flip-flop. The output of said flip-flop on the line 526 is input to FIG. 8 which discloses the repeat circuitry. The sign indicator is set or reset by two pulse generators. A first is composed of the NOR gates 460, 462 and capacitor 464. A second is composed of the NOR gates 466, 468 and the capacitor 470. These pulse generators put out a pulse on the down going edge of the input signal as discussed previously. Error polarity for a given cycle is defined by the time sequence of input pulses on the lines 528 and 530. Recall that the down going edge on the line 528, from flip-flop 452 is generated when the values in the scanner difference counters and the cylinder position counters are equal, FIG. 5. The down going edge on the line 530 from the flip-flop 494, FIG. 7B, is generated when the value in the fine adjust counters equals the value preset on the fine adjust switches, FIG. 6. The key to the implementation is the exclusive NOR gate 496, FIG. 7B, FIG. 7C, illustrates the two possible timing sequences. In sequence 1, FIG. 7C, the signal on the line 530 goes down at time TB *before* the signal on the line 528. Hence, the output of the sign flip-flop on the line 526 is forced low at time TC. In sequence 2, FIG. 7C, the signal on the line 530 goes low at time TF *after* the signal on the line 528. Hence, the output of the sign flip-flop on the line 526 is forced high. Note that the actual error pulses are generated during the time the signal on the line 520 is high. It can be seen that the error pulses on the line 522, FIG. 7B, are generated before the sign flip-flop has been properly set or reset. This is of no consequence since the sign is detected in the repeat circuitry of FIG. 8 when the inspection zone signal from the flip-flop 486, FIG. 7B, goes down at the end of the inspection zone.

The repeat circuitry, 180 of FIG. 3A, is disclosed in detail in FIG. 8. The purpose of this circuitry is to average the error signal produced in the previously disclosed circuitry over 2, 4 or 8 data acquisition cycles. Each cycle corresponding to one rotation of the print cylinder. The result of such averaging is to smooth the operation of the lateral positioning of the print cylinder. It is also possible to not average the error signal and output it after each acquisition cycle. The repeat circuitry comprises two repeat counters 550, 552, a manually settable repeat select switch having two ganged poles 554, 556, a set of counters 558, 560 and 562 which accumulate the error counts for a specified number of repeat cycles, an error counter reset pulse generator composed of three NOR gates 564, 568, 570 and the capacitor 572, a zero comparator represented by collective element 574, up/down indicator circuitry consisting of the flip-flops 576, 578, 580 and the gates 582, 584, 586, 588, 590, 592, 594, 596 and sign elements consisting of the flip-flops 598, 600, 602, gates 604, 606, 608, 609 and a pulse generator composed of NAND gates 610, 612 and the capacitor 616, buffers 614, 615 and fail-safe gate 591.

Consider first the case where the repeat select switch is set as shown with the poles 554 and 556 set to the non-repeat position. That is, after each error pulse train is acquired, it is immediately used to position the print cylinder. This operation has three phases. First, the error pulse train is counted up. Next, the state of the motor direction flip-flop is updated. Finally, the buffers are loaded.

At the start of any repeat sequence or at the start of every sequence where no averaging is to be used, the counters 558, 560, 562 are caused to count up independently of the ultimate error sign. That is, said counters contain the absolute value of the current error. The operational sequence is as follows: at the start of the inspection zone the differentiated set point square-wave appears at the line 624. In the indicated mode, the counter 550 is bypassed and the pulse generator composed of gates 564, 568 and capacitor 572 outputs a pulse which is inverted by the gate 570. The function of said pulse is to zero the counters 558, 560 and 562. When the output of said counters goes to zero, a positive going signal appears at the line 626, is inverted by the gate 596 and is exclusive NORED at the gate 590 with the normally high output of the inverter 570. Since the element 590 is an exclusive NOR gate, a high and a low input will result in a low output on the line 630 which will clear the flip-flop 580 making the level on the line 632 go low. Line 632 being low causes the error counters 558, 560, 562 to count up. The clock and "D" inputs to the flip-flop 580 only contribute to the state of said flip-flop when a repeat of 8, 4 or 2 cycles has been specified by the manually settable switches 554, 556. When the error pulse train appears on the line 628 from FIG. 7B, the counters 558, 560 and 562 are counted up to the total error.

The state of the motor direction flip-flop 602 is updated at the end of every data acquisition cycle no matter how many repeats are specified on the repeat select switch. The inspection zone signal appears at the line 634 and is generated at FIG. 7B. When the inspection zone terminates, the positive going signal on the line 634 causes the pulse generator consisting of NAND gates 610, 612 and capacitor 616 to generate a down going pulse. This pulse is inverted by the NOR gate 609. Note that each time the counters 558, 560, 562 go to zero, the flip-flop 598 will be set. Similarly, each time a pulse appears at the output of NOR gate 570, the flip-flop 600 will be clocked. Thus, in the present mode, the flip-flops 598, 600 are always set at the start of an error count cycle. Since in this case one input to each of the gates 604, 606 is high, the positive going pulse on the line 636 is transmitted through both gates to the exclusive NOR gate 608. The capacitor 638 on the output to the gate 604 shifts the phase slightly between each of the inputs to the gate 608 which outputs a clock pulse to the flip-flop 602. Since the D input to said flip-flop is tied to the sign indicator flip-flop of FIG. 7A, the motor direction flip-flop thus follows the sign indicator flip-flop. The final requirement is to load the buffers 614, 615 with the previously acquired values of the error storage counters 558, 560, 562. This is done via the line 640 when the *next* differentiated set point square-wave is detected by the pulse generator consisting of gates 564, 568 and the capacitor 572. These buffered outputs are available for use by the downstream circuitry of FIG. 9 during the next cycle when a new error pulse train is counting up the counters 558, 560, 562.

In the cases where the manually selected switch having poles 554, 556 is set in the "2", "4" or "8" position, the counters 550, 552 are not zeroed at the start of each error pulse train but two, four or eight such pulse trains are averaged together before a new error value is output to the buffers 614, 615. To understand the operation of the up/down indicators of FIG. 8, reference must first be made to FIG. 7C. With respect to the sign indicator waveform of FIG. 7C, note that in sequence #1 and sequence #2 that TB and TE correspond to the start of the error pulse train. Further, TC and TF correspond to the end of that pulse train. Even though the sign indicator flip-flop does not attain its final state until time TC or TF, the state it assumes between TB, TC and TE, TF may be used to predict its final state. Table 1 which follows summarizes the possible values of the sign indicator flip-flop. H is high, L is low.

TABLE 1

| Before TA or TD | Between TB, TC or TE, TF | After TC or TF |
|---|---|---|
| L | H | L |
| H | H | L |
| L | L | H |

TABLE 1-continued

| Before TA or TD | Between TB, TC or TE, TF | After TC or TF |
|---|---|---|
| H | L | H |

It should be noted that if the final sign for this sequence of error pulses is low during the time the encoder pulse train is present, the sign indicator flip-flop has a high output. If the final value is high, then, during the time that the encoder pulse train is present the sign indicator flip-flop has a low output. Thus, on each repeat cycle after the initial one, the counters 558, 560, 562 count the same direction or change direction of counting depending on whether the sign indicator output for the last cycle is the same as the present cycle. For example, if the poles 554, 556 are set to the "2" position, on the initial cycle, the counters 558, 560, 562 are counted up exactly as discussed for the non-averaging case. The motor direction flip-flop 602 is set or reset depending upon the state of the sign indicator flip-flop. However, when the second differentiated set-point square-wave arrives on the line 624, the up/down indicators potentially effect the direction of counting of the counters 558, 560, 562. The signal on the line 624 counts the counter 550 from a count of one to a count of two. It is inverted by the gate 582 and the signal on the line 642 clocks the flip-flop 576 wherein the state of the sign indicator flip-flop for the previous cycle is now stored. The flip-flop 578 is also cleared by the signal on the line 642. Note from Table 1 that if the direction of counting, whether up or down is to remain the same, there is a difference between the previous output of the sign indicator flip-flop and its output while the current string of encoder pulses is being generated. This difference or lack of difference is detected in the exclusive NOR gate 584 and used to control the direction of counting of the counters 558, 560, 562.

Assume for the sake of example the previous state of the sign indicator flip-flop was high. Also assume that this next sequence of error pulses has the opposite sign. Since this is still a case where two repeats are specified due to the position of the poles 554, 556, then it is required that the counters count up on the first data acquisition sequence and down on the second. With respect to both FIGS. 8A and 8B, at time TB, the line 644 is high, the line 645 is also high due to the unchanging state of the sign indicator flip-flop on the line 526, FIG. 7A. The output of the exclusive NOR gate 584 is high, the gate 586 has a high input on the line 646 as one input and a low on the line 632 for the other input. The output of the gate 586 is thus low, it is inverted by the gate 588 placing a high on the line 648 which is the D input to the flip-flop 580.

On the first encoder pulse, the flip-flop 578 is clocked which clocks the flip-flop 580 and causes the counters 558, 560, 562 to count down. The subsequent error pulses on the line 628 count up the counter 552 whose output in turn pulses counters 558, 560, 562.

It can thus be seen that each time such sign changes are detected, the direction of counting is changed. If the error counters are counted down to zero not only must the error counters 558, 560, 562 change direction of counting and start to count up again but the motor direction flip-flop 602 also needs to be updated. Each time the error counters count down to zero, the zero detector, collective element 574 outputs a positive going pulse on the line 626 which is inverted by the gate 596 and exclusive NORED in the gate 590. On zero detection, the output of the gate 590 on the line 630 clears the flip-flop 580 causing the counters 558, 560, 562 to start counting up again. Additionally, the zero detect signal on the line 626 clocks the flip-flop 598 and at the end of the current inspection zone the gate 604 via the gate 608 updates the motor direction flip-flop 602. It should be noted that the flip-flop 602 is updated at the end of each inspection zone though the value of the averaged error magnitude stored in the buffers 614, 615 is only updated after two, four or eight data acquisition sequences. Updating the sign of the error continually while averaging the magnitude of error improves system response over what it would be if the sign indicator were only updated when the magnitude was updated. The repeat circuitry works analogously if four or eight repeats are specified by the operator.

Figure 9:
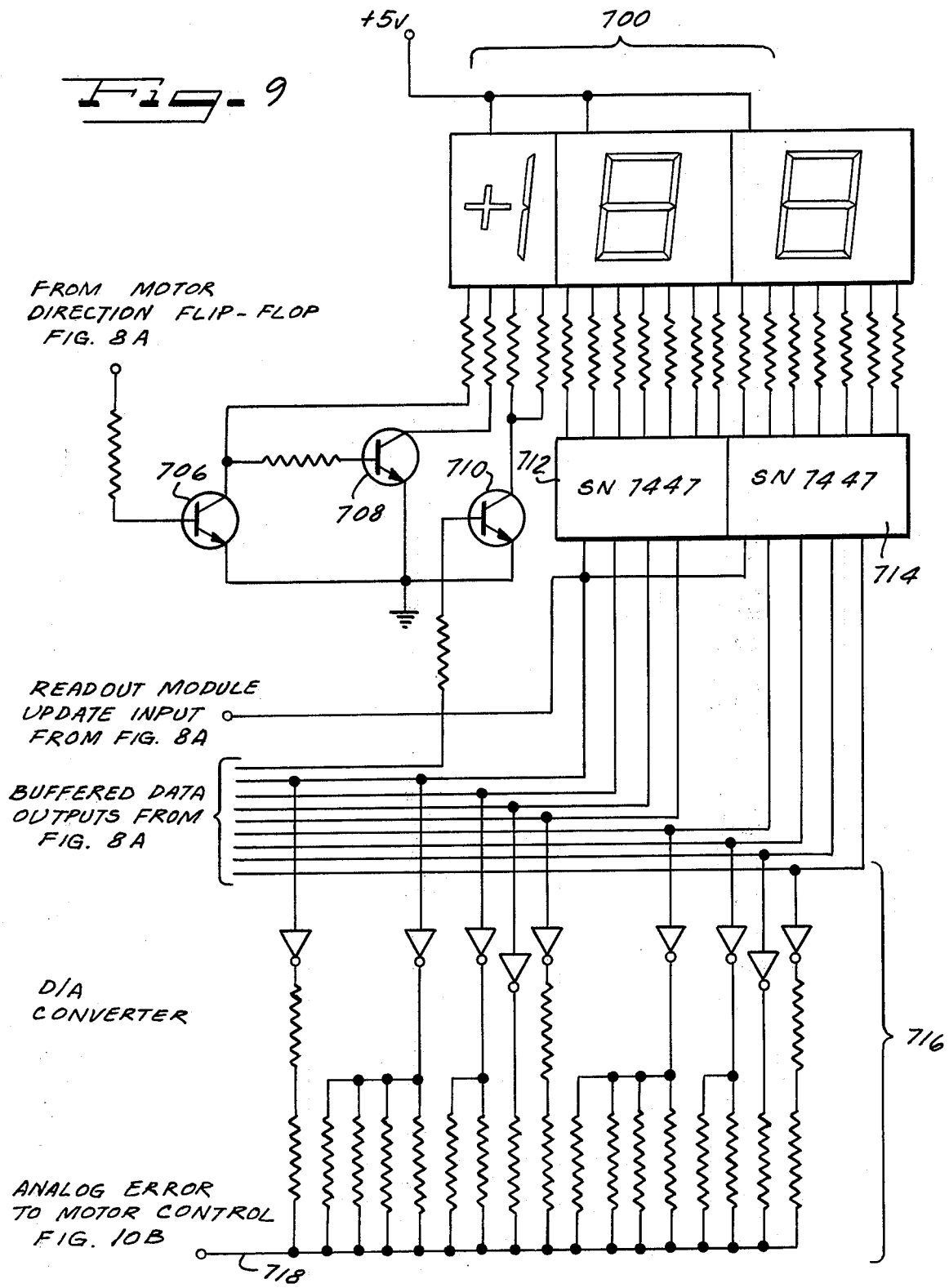
FIG. 9 discloses the readout device and D/A converter.

FIG. 9 discloses the digital readout device 700, with associated drive transistors 706, 708, 710 and the integrated drive circuits 712, 714. Additionally, the D/A converter, collective element 716 is disclosed. The buffered data outputs from the buffers 614, 615 of FIG. 8A represent the error magnitude in binary-coded-decimal form. The display device 700 of FIG. 9 is a standard seven-line visual indicator which accepts binary-coded-decimal input. The transistors 706, 708 provide drive to light the sign of the display while the transistor 710 and the integrated circuits 712, 714 provide drive current for the numerals. The D/A converter 716 is a standard binary-coded-decimal to analogue ladder network whose analogue output on the line 718 is high for low error and decreases toward zero volts for lower error.

FIG. 10 discloses the motor control circuitry which drives the print cylinder lateral position motor.

Figure 10A:
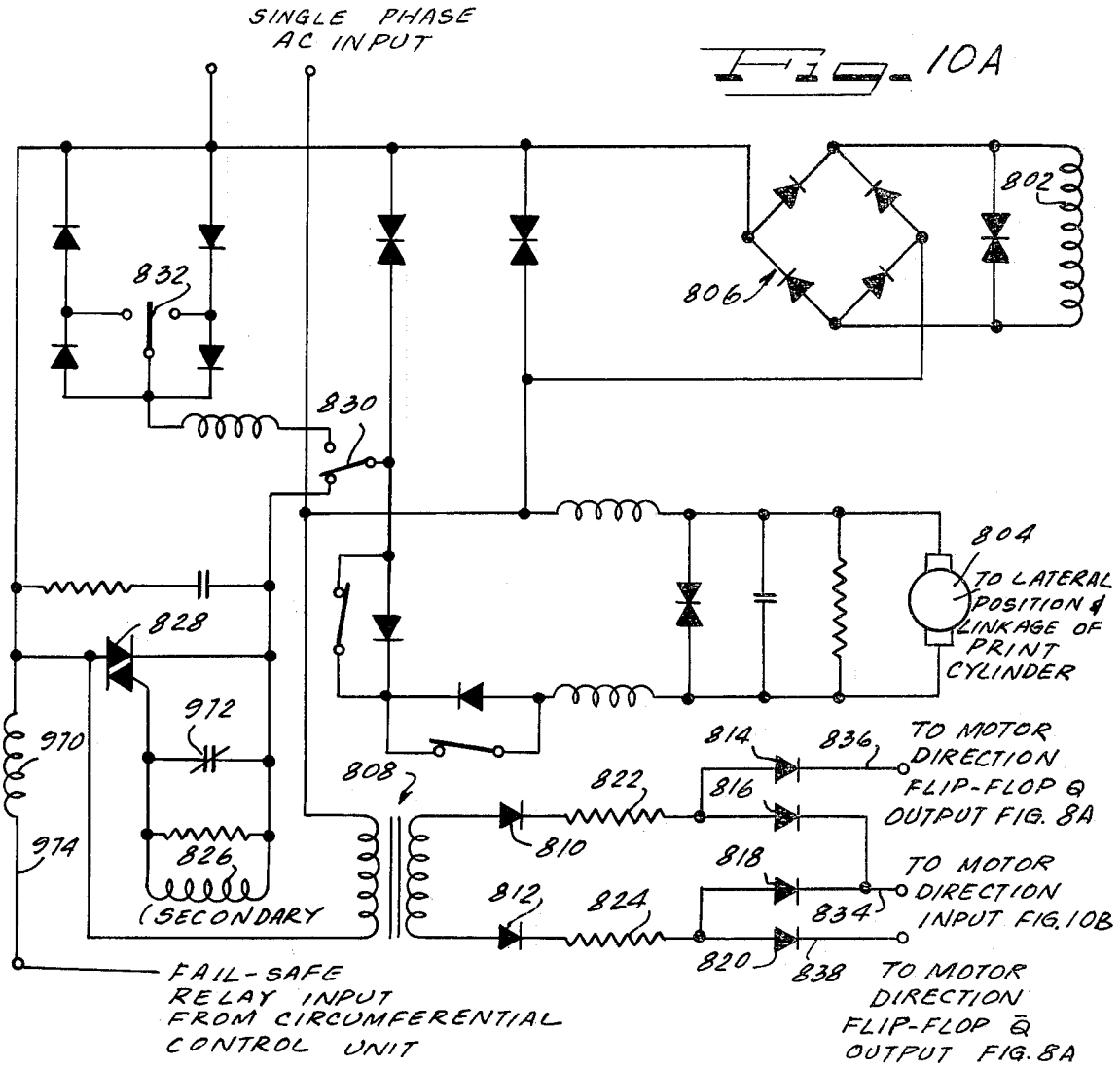
FIG. 10A discloses the power and direction circuitry for the DC lateral position motor.
Figure 10C:
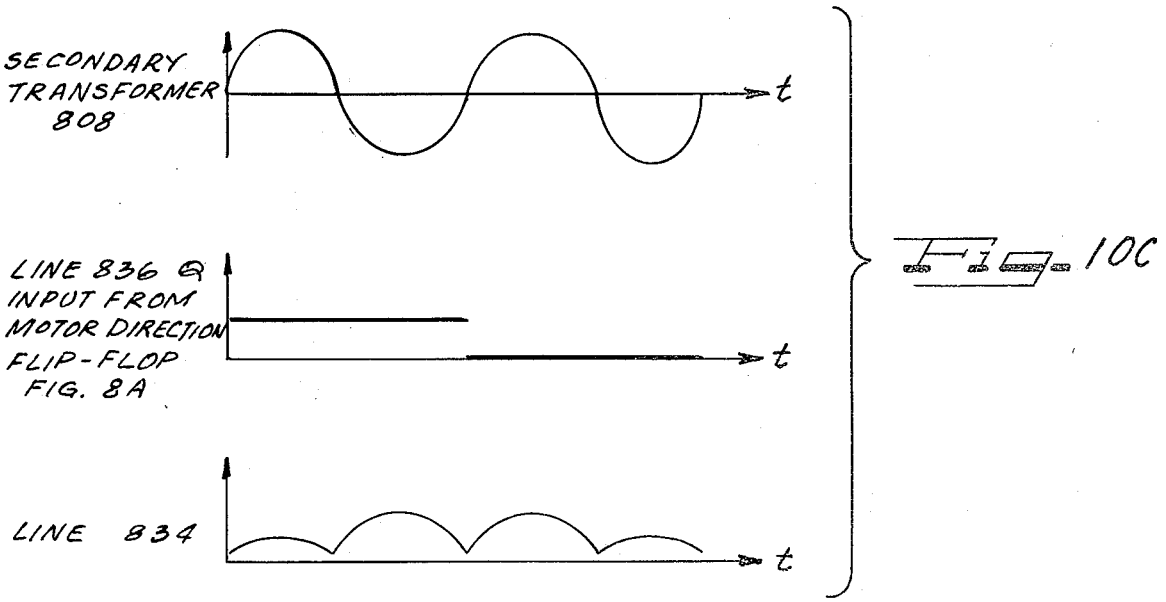
FIG. 10 consists of 10A through 10C.
FIG. 10B discloses the lateral position motor rate control electronics.
Figure 10B:
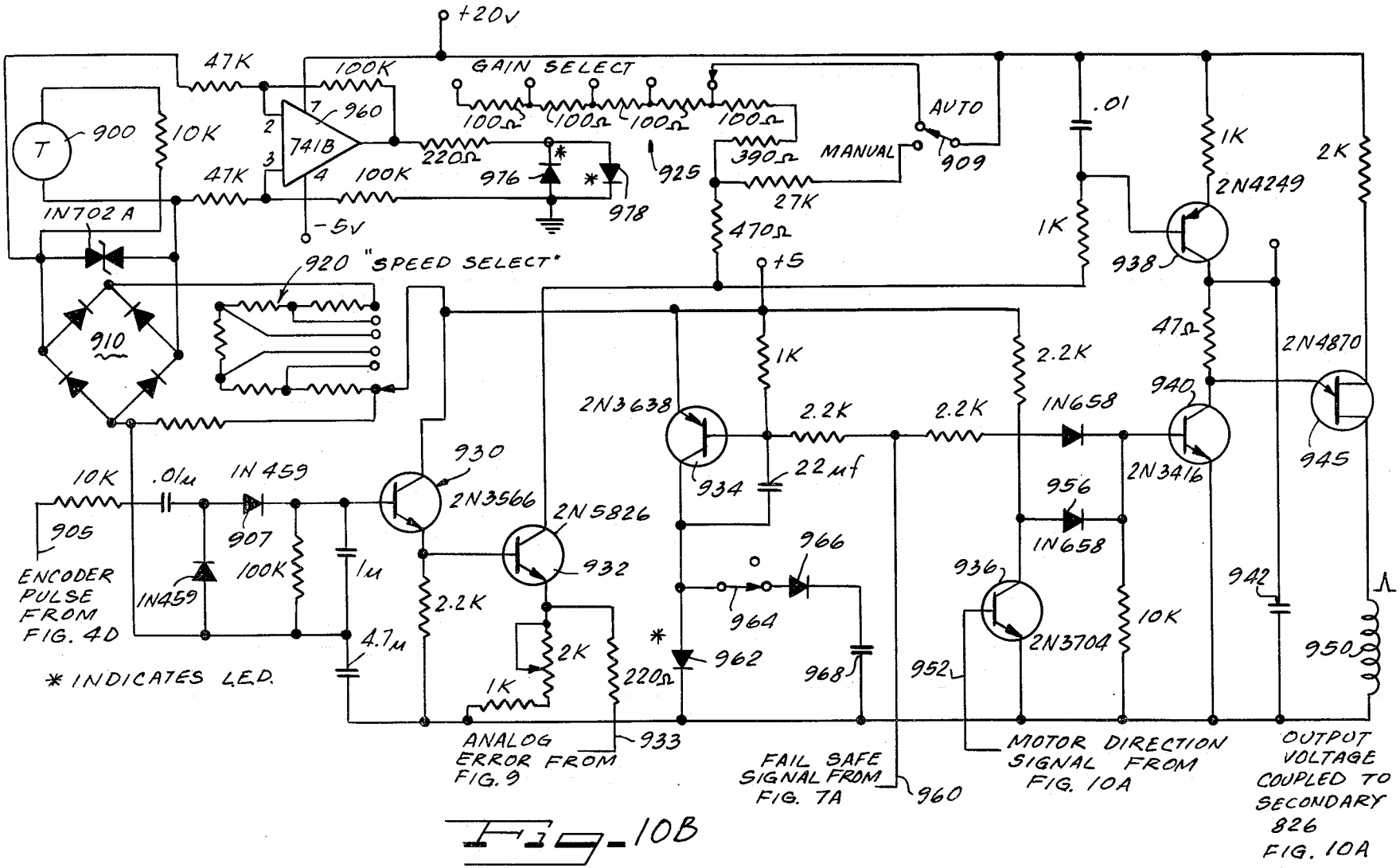

FIG. 10A discloses the power and direction circuitry for the DC later position motor. FIG. 10B discloses the rate control electronics. FIG. 10A comprises the field coil 802, motor armature 804, field full wave rectifier 806, direction sensing circuitry composed of transformer 808, diodes 810, 812, 814, 816, 818, 820 and resistors 822, 824; voltages induced in the secondary transformer winding 826 provide gate input to the triac 828 which in turn controls the AC applied to the armature 804; the switches 830, 832 provide the operator a manual means to position the control motor. Also disclosed in FIG. 10A are noise suppressing capacitors, resistors and inductors as would be known to one ordinarily skilled in the art of motor control. With respect to FIG. 10A, the motor field 802 is powered by DC from the full-wave rectifier 806. The armature 804 is powered by DC controlled by the triac 828 which is triggered via the transformer, secondary 826.

The direction circuitry operates by producing a low voltage positive AC on the line 834 during the selected half of the single phase AC input depending on the polarity of the motor direction flip-flop 602, FIG. 8A which is connected to the inputs 836, 838 of FIG. 10A. The waveshapes of FIG. 10C illustrate that the diodes 814 or 820 clamp the output of the transformer 808 or are reverse-biased and depending on the polarity of the output of the secondary transformer 808, diodes 816 or 818 conduct or do not conduct giving out a positive going signal on the line 834 in phase with the source of AC power and which is gated by the motor direction flip-flop 602 of FIG. 8A. This signal is used in the motor control circuitry of FIG. 10B to enable a unijunction transistor oscillator which pulses the primary coil associated with the secondary 826 such that positive or negative rectified AC is supplied by the triac 828 to the motor armature 804 during the correct phase to produce the required direction of motion.

FIG. 10B discloses the print cylinder drive motor tachometer 900, a full-wave bridge 910, attenuation resistor networks 920 and 925, control transistors 930, 932, 934, 936, 938, 940, unijunction transistor 945, pulse transformer primary 950, operational amplifier 960 and resistors, capacitors and diodes whose use would be known and understood by one ordinarily skilled in the art. With respect to the detailed operation of FIG. 10B, encoder pulses from FIG. 4D are input via the line 905. As the number of encoder pulses per unit time increases, speed increases forward biasing the diode 907 which tends to turn on the transistor 930. The speed of the print cylinder motor as reflected by the negative output of the tachometer 900, rectified by the diode bridge 910 and attenuated by the resistor network 920 tends to turn off the transistor 930 thus opposing the effects of the encoder pulse train on the line 905. When the "auto-manual" switch 909 is set in the manual position, the output of the tachometer 900 is about minus 28 volts. The output of the transistor 930 tends to forward bias the base of the transistor 932. The analog error voltage is input to the emitter of the transistor 932 on the line 933. This voltage is high, positive for small errors and approaches ground for larger errors. Thus, for a given input to the base of the transistor 932, which is speed dependent, the analog error directly affects the extent to which the transistor 932 conducts. As the transistor 932 conducts more heavily, the transistor 938 also tends to conduct more. Assuming now that the transistor 940 is cut off, as the transistor 938 conducts more heavily, the capacitor 942 is charged up at a faster rate thus raising the voltage at the base of the unijunction 945 to its firing point. When the unijunction transistor 945 fires, the current pulse generates a voltage in the pulse transformer primary 950 which induces a voltage in the secondary of the same transformer 826 of FIG. 10A. The unijunction transistor 945 is permitted to oscillate only during selected AC phases so that the armature of the print cylinder lateral position motor 804 of FIG. 10A turns in the correct direction. When the signal on the line 952 goes high, the transistor 936 conducts reverse biasing the diode 956 which in turn allows the transistor 940 to turn off. Conversely, when the line 952 goes low, the transistor 936 turns off resulting in the diode 956 becoming forward-biased, turning the transistor 940 on and blocking the unijunction 945 from oscillating.

The circuitry also detects several conditions and on detection of any one of them goes into a "fail-safe" mode where the unijunction transistor 945 is inhibited from firing. The fail-safe signal appears on the line 960. When the equipment is operating properly, the line 960 is low. When a failure mode is detected, the line 960 goes high. The transistor 934 provides drive current to indicate visually that the fail-safe signal is low. With the line 960 low, the transistor 934 conducts causing the diode 962 to emit light. If the line 960 goes high, the transistor 934 is biased off and no light is emitted. If the switch 964 is set to "auto", the diode 966 emits light so long as the normally open relay contacts 968 stay closed. The coil 700, FIG. 10A, energizes the contacts 968, FIG. 10B, and the normally closed contacts 972, FIG. 10A. The coil 970, FIG. 10A, is normally conducting because the line 974, FIG. 10A, is grounded through the circumferential control unit, Appendix A, assuming it also is operating correctly.

The fail-safe signal is generated by NOR gate 456, FIG. 7A. Fail-safe occurs when a count of 190 is detected from the readout buffers 614, 615, FIG. 8, or, two pulses/revolution are not detected from the magnetic pickup element 75 of FIG. 2 or the lateral scan signal has not come before the circumferential scan signal and after the inspection-zone has started.

The operational amplifier 960, FIG. 10A, merely provides a visual output to an operator via diodes 976, 978 as to which direction the print cylinder motor is actually turning.

I claim as my invention:

1. A lateral register control system for locating the lateral position of a rotary member at a work applying station to minimize lateral register errors on a traveling web; the web having had indicia applied before entering the work applying station which indicia provide for discrimination of the lateral position of the web at the work station, the system including:

a source of clock pulses;

first means for sensing indicia on the web in proximity to the work applying station and operable to obtain a count of clock pulses representing the instantaneous lateral position of the web;

second means comprising a cylinder having a first and second indicia at a predetermined angle with respect to one another, mechanically connected to the rotary member, for sensing the lateral position of the rotary member at the work applying station and operable to obtain a count of clock pulses representing the instantaneous lateral position of the rotary member at the work applying station; and third means connected to said source of clock pulses said first means and said second means for comparing the lateral position of the web to the lateral position of the rotary member at the work applying station and operable to laterally shift the rotary member such that the difference between the lateral register of the web and that of the rotary member is minimized.

2. A lateral register control system for locating the lateral position of a work applying rotary member at a work station to minimize lateral register error on a traveling web; the web having pairs of preprinted reference marks on it when it enters the work station with one member of the pair being at a predetermined angle with respect to the direction of web movement and the second member of the pair at a predetermined different angle with respect to the first, the system including:

a first means for sensing the mark pairs on the web;

a second means comprising a member symmetrical about an axis of rotation having a first and a second indicia at a predetermined angle with respect to one another, connected to the rotary member to be controlled with said axis of rotation being substantially parallel to the axis of rotation of the rotary member, for sensing the lateral position of that rotary member;

a source of clock pulses; and a third means connected to said first and second means and being further connected to said source of clock pulses and connected to the rotary member to be controlled and being operable to compare the time interval between sensed elements of a web mark pair with the lateral position of the rotary member and then to move the rotary member laterally based on said comparison to minimize the difference.

3. A lateral register control system for locating the lateral position of a work applying rotary member at a work station to minimize lateral register errors on a traveling web; the web having pairs of preprinted reference marks on it when it enters the work station with one member of the pair being at a predetermined angle with respect to the direction of web movement and the second member of the pair at a predetermined different angle with respect to the first, the system including:

a first means for sensing the mark pairs on the web;

a second means comprising a member symmetrical about an axis of rotation having a first and a second indicia at a predetermined angle with respect to one another, connected to the rotary member to be controlled for sensing the lateral position of that rotary member;

a source of clock pulses; and a third means connected to said first and second means and being further connected to said source of clock pulses and connected to the rotary member to be controlled and being operable to compare the time interval between sensed elements of a web mark pair with the lateral position of the rotary member and then to move the rotary member laterally based on said comparison to minimize the difference.

4. A lateral register control system for locating the lateral position of a work applying rotary member at a work station to minimize lateral register errors on a traveling web; the web having pairs of preprinted reference marks on it when it enters the work station with one member of the pair being at a pedetermined angle with respect to the direction of web movement and the second member of the pair at a predetermined different angle with respect to the first, the system including:

a first means for sensing the mark pairs on the web; a second means connected to the rotary member to be controlled for sensing the lateral position of that rotary member;

a source of clock pulses; and a third means connected to said first and second means and being further connected to said source of clock pulses and connected to the rotary member to be controlled and being operable to compare the time interval between sensed elements of a web mark pair with the lateral position of the rotary member and then to move the rotary member laterally based on said comparison to minimize the difference, wherein said second means comprises a nonmagnetic cylinder having two magnetic wires mounted thereon with an associated sensor unit;

said cylinder being mounted on the shaft of the rotary member whose lateral position is to be controlled and rotating and moving laterally in conjunction with that rotary member;

said sensor unit being operable to produce two pulses for each revolution of said nonmagnetic cylinder, one pulse being produced as each of said wires turns under said sensor unit;

a first of said two magnetic wires being mounted at a predetermined angle with respect to the axis of rotation of said cylinder with a second of said two wires mounted at a predetermined different angle and at a predetermined distance from said first wire.

5. The lateral register control system according to claim 4 where the pairs of preprinted reference marks are preprinted by an upstream print cylinder and wherein said source of clock pulses comprises an encoder having its shaft connected to the same upstream print cylinder as printed the reference marks on the web and being operable to provide a common source of clock pulses to any lateral register control units operating with respect to that set of preprinted reference marks.

6. A lateral register control system for locating the lateral position of a rotary member at a work applying station to minimize lateral register errors on a traveling web; which web contains reference mark pairs printed on the web before it enters the work applying station with one member of the pair being at a predetermined angle with respect to the direction of web movement and the second member of the pair at a predetermined different angle with respect to the first, comprising:

a pulse source;

an optical scanner operable to sense the presence of the reference marks on the web;

a nonmagnetic cylinder having two magnetic wires mounted thereon, at a pre-selected angle and at a pre-selected spacing with respect to one another with one of said wires being parallel to the axis of rotation of said cylinder, and with the second of said wires being at a pre-selected angle with respect to said first wire, said cylinder being mounted on the shaft of the rotary member whose lateral register is to be controlled and rotating and moving laterally with that rotary member, having also an associated scanner unit operable to produce two pulses for each revolution of the print cylinder, one pulse being produced as each of said wires turns under said scanner unit;

first means for sensing the output of said optical scanner and operable to measure the lateral position of the web by obtaining a count of clock pulses from said clock source proportional to the lateral position of the web;

second means for sensing the output of said associated scanner unit and operable to measure the lateral position of the rotary member by obtaining a count of clock pulses from said clock source proportional to the lateral position of the rotary member; and third means for comparing the web lateral postion as determined by said first means to the lateral position of the rotary member and operable to then shift the rotary member laterally to minimize the lateral position difference between the web and the rotary member;

said first means being connected to said optical scanner and said third means;

said second means being connected to said associated scanner and said third means.

7. The lateral register control system according to claim 6 having additionally an operator setable repeat select switch and fourth means for repeat control; said fourth means being connected to said operator setable repeat switch and said third means and operable to repeat the comparison cycle the number of times specified by said operator setable repeat select switch such that an average lateral error is determined before said third means shifts the rotary member.

8. The lateral register control system according to claim 7 where the pairs of preprinted reference marks are preprinted by an upstream print cylinder and wherein said pulse source comprises an encoder having its shaft connected to the same upstream print cylinder as printed the reference marks on the web and being operated to provide a common source of clock pulses to any lateral register control units operating with respect to that set of preprinted reference marks.

9. Apparatus for maintaining lateral register of a web at a work applying station, wherein a rotary member at the station is to have a predetermined lateral register condition relative to the web and wherein clock pulses are generated as a function of web movement; each representing an increment of movement of the web, said apparatus comprising:

means for sensing indicia preprinted on the web at a web sensing location in proximity to the work applying station and obtaining a count of encoder pulses representing the instantaneous lateral position of the web;

means for rotating further indicia in step with the rotary member and providing a scanning location relative to the path of the rotary indicia such that the relative lateral position of such path with respect to the scanning location is measured by obtaining a count of encoder pulses representing the instantaneous lateral position of said rotary member;

means for comparing the instantaneous lateral position of the web with that of the rotating member and deriving from such comparison the instantaneous error in the lateral position of the web relative to said rotary member; and, means for relatively laterally shifting said rotary member relative to said web to minimize the error and substantially maintain the desired lateral registration therebetween at said work applying station.

10. A lateral register control system for locating the lateral position of a rotary member at a work applying station to minimize lateral register errors on a traveling web; the web having had indicia applied before entering the work applying station which indicia provide for discrimination of the lateral position of the web at the work station, the system including:

a source of clock pulses;

first means for sensing indicia on the web in proximity to the work applying station and operable to obtain a count of clock pulses representing the instantaneous lateral position of the web;

second means connected to the rotary member, for sensing the lateral position of the rotary member at the work applying station and operable to obtain a count of clock pulses representing the instantaneous lateral position of the rotary member at the work applying station; and third means connected to said source of clock pulses said first means and said second means for comparing the lateral position of the web to the lateral position of the rotary member at the work applying station and operable to laterally shift the rotary member such that the difference between the lateral register of the web and that of the rotary member is minimized, wherein said second means comprises a nonmagnetic cylinder having two magnetic wires mounted thereon along with an associated sensor unit;

said cylinder being mounted on the shaft of the rotary member at the work station whose lateral position is to be controlled and rotating and moving laterally in conjunction with the rotary member;

said sensor unit being operable to produce two pulses for each revolution of said nonmagnetic cylinder, one pulse being produced as each of said wires turns under said sensor unit;

a first of said two magnetic wires being mounted at a predetermined angle with respect to the axis of rotation of said cylinder with a second of said two wires mounted at a predetermined different angle and at a predetermined distance from said first wire.

* * * * *